US009771793B2

(12) United States Patent
Fraser et al.

(10) Patent No.: US 9,771,793 B2
(45) Date of Patent: Sep. 26, 2017

(54) DOWNHOLE APPARATUS, DEVICE, ASSEMBLY AND METHOD

(71) Applicant: Halliburton Manufacturing and Services Limited, Dyce, Aberdeen (GB)

(72) Inventors: Simon Benedict Fraser, Aberdeen (GB); William Brown-Kerr, Aboyne (GB); Bruce Hermann Forsyth McGarian, Stonehaven (GB)

(73) Assignee: Halliburton Manufacturing and Services Limited, Dyce (GB)

( * ) Notice: Subject to any disclaimer, the term of this patent is extended or adjusted under 35 U.S.C. 154(b) by 228 days.

(21) Appl. No.: 13/898,052

(22) Filed: May 20, 2013

(65) Prior Publication Data

US 2013/0292110 A1 Nov. 7, 2013

Related U.S. Application Data

(63) Continuation-in-part of application No. 13/382,070, filed as application No. PCT/GB2010/051094 on Jul. 2, 2010.

(30) Foreign Application Priority Data

Jul. 8, 2009 (GB) ..... 0911844.9

(51) Int. Cl.
*E21B 7/06* (2006.01)
*E21B 47/12* (2012.01)
(Continued)

(52) U.S. Cl.
CPC ..... *E21B 47/18* (2013.01); *E21B 7/061* (2013.01); *E21B 7/06* (2013.01); *E21B 41/0035* (2013.01);
(Continued)

(58) Field of Classification Search
CPC ..... E21B 47/12; E21B 47/14; E21B 47/18; E21B 47/182; E21B 47/185;
(Continued)

(56) References Cited

U.S. PATENT DOCUMENTS 2,887,298 A 2/1958 Hampton
3,255,353 A * 6/1966 Scherbatskoy ..... 250/254
(Continued)

FOREIGN PATENT DOCUMENTS

EP 0 553 908 8/1993
EP 0617196 9/1994
(Continued)

*Primary Examiner* — Hai Phan
*Assistant Examiner* — Franklin Balseca
(74) *Attorney, Agent, or Firm* — McDermott Will & Emery LLP

(57) ABSTRACT

The invention relates to a wellbore-lining tubing comprising at least one window pre-formed in the wall of the tubing and a device for selectively generating a fluid pressure pulse, and to a method of forming a lateral wellbore employing such a tubing.

In an embodiment, a wellbore-lining tubing (130*m*) is disclosed which comprises: a tubing wall (32*m*), an internal fluid flow passage (30*m*), and at least one window (154*m*) pre-formed in the wall of the tubing; a device (34*m*) for selectively generating a fluid pressure pulse, the device located at least partly in a space (36*m*) provided in the wall of the tubing; and a coupling (190) for receiving a deflection tool (192) so that the deflection tool can be secured to the tubing and employed to divert a downhole component (202) through the window in the tubing wall.

26 Claims, 16 Drawing Sheets

(51) Int. Cl.
*E21B 47/18* (2012.01)
*E21B 41/00* (2006.01)
*E21B 43/10* (2006.01)

(52) U.S. Cl.
CPC ..... *E21B 41/0042* (2013.01); *E21B 43/103* (2013.01); *E21B 43/108* (2013.01); *E21B 47/12* (2013.01); *E21B 47/182* (2013.01); *E21B 47/187* (2013.01)

(58) Field of Classification Search
CPC ..... E21B 47/187; E21B 47/09; E21B 7/06; E21B 7/061; E21B 41/0035; E21B 41/0042; E21B 43/103; E21B 43/08; E21B 43/086; E21B 43/10; E21B 43/108
USPC ..... 367/80, 83, 85
See application file for complete search history.

(56) References Cited

U.S. PATENT DOCUMENTS 4,078,620 A 3/1978 Westlake
4,491,738 A 1/1985 Kamp
4,499,563 A * 2/1985 Jurgens ..... E21B 47/18 175/48
4,520,468 A * 5/1985 Scherbatskoy ..... 367/83
4,535,429 A 8/1985 Russell
4,577,689 A * 3/1986 Dotson ..... 166/250.1
4,636,995 A 1/1987 Russell et al.
4,771,408 A * 9/1988 Kotlyar ..... E21B 47/18 175/40
4,979,577 A * 12/1990 Walter ..... 175/56
5,000,272 A 3/1991 Wiebe et al.
5,079,750 A 1/1992 Scherbatskoy
5,113,379 A 5/1992 Scherbatskoy
5,467,832 A 11/1995 Orban et al.
6,092,601 A * 7/2000 Gano et al. ..... 166/298
6,279,670 B1 8/2001 Eddison et al.
6,308,782 B1 * 10/2001 Brooks et al. ..... 166/313
6,850,463 B2 2/2005 Winnacker
7,139,219 B2 11/2006 Kolle et al.
7,145,834 B1 12/2006 Jeter
7,430,153 B2 * 9/2008 Fraser ..... E21B 47/187 166/386
8,151,904 B2 4/2012 Krueger et al.
9,243,492 B2 1/2016 Fraser
2002/0124652 A1 9/2002 Schultz
2003/0155153 A1 * 8/2003 Masak ..... E21B 28/00 175/48
2004/0069530 A1 4/2004 Prain et al.
2005/0045344 A1 3/2005 Fraser et al.
2005/0260089 A1 11/2005 Hahn et al.
2007/0175665 A1 * 8/2007 Tessari et al. ..... 175/65
2008/0060846 A1 * 3/2008 Belcher et al. ..... 175/25
2009/0056938 A1 * 3/2009 Treviranus ..... E21B 7/20 166/255.2
2009/0114396 A1 5/2009 Kusko et al.
2010/0148987 A1 6/2010 Spross et al.
2010/0243265 A1 9/2010 Sherrill et al.

FOREIGN PATENT DOCUMENTS

EP 2088282 12/2009
GB 2 120 432 11/1983
GB 2164682 3/1986
WO 99/27224 6/1999
WO 2011036471 3/2011

* cited by examiner

DOWNHOLE APPARATUS, DEVICE, ASSEMBLY AND METHOD

CROSS-REFERENCE TO RELATED APPLICATIONS

This application is a continuation-in-part of application Ser. No. 13/382,070, filed Jan. 3, 2012, which was the National Stage of International Application No. PCT/GB2010/051094, filed Jul. 2, 2010, which claims priority to United Kingdom Patent Application No. 0911844.9.

BACKGROUND OF THE INVENTION

The present invention relates to apparatus for generating a fluid pressure pulse downhole. The present invention also relates to a downhole assembly comprising a first apparatus for generating a fluid pressure pulse downhole and at least one further such apparatus, to a device for selectively generating a fluid pressure pulse downhole, and to a method of generating a fluid pressure pulse downhole. The present invention also relates to a wellbore-lining tubing comprising at least one window pre-formed in the wall of the tubing and a device for selectively generating a fluid pressure pulse, and to a method of forming a lateral wellbore employing such a tubing.

In the oil and gas exploration and production industry, a wellbore is drilled from surface utilising a string of tubing carrying a drill bit. Drilling fluid known as drilling 'mud' is circulated down through the drill string to the bit, and serves various functions. These include cooling the drill bit and returning drill cuttings to surface along an annulus formed between the drill string and the drilled rock formations. The drill string is typically rotated from surface using a rotary table or top drive on a rig. However, in the case of a deviated well, a downhole motor may be provided in the string of tubing, located above the bit. The motor is driven by the drilling mud circulating through the drill string, to rotate the drill bit.

It is well known that the efficiency of oil and gas well drilling operations can be significantly improved by monitoring various parameters pertinent to the process. For example, information about the location of the borehole is utilised in order to reach desired geographic targets. Additionally, parameters relating to the rock formation can help determine the location of the drilling equipment relative to the local geology, and thus correct positioning of subsequent wellbore-lining tubing. Drilling parameters such as Weight on Bit (WOB) and Torque on Bit (TOB) can also be used to optimise rates of penetration.

For a number of years, measurement-whilst-drilling (MWD) has been practiced using a variety of equipment that employs different methods to generate pressure pulses in the mud flowing through the drill string. These pressure pulses are utilised to transmit data relating to parameters that are measured downhole, using suitable sensors, to surface. Systems exist to generate 'negative' pulses and 'positive' pulses. Negative pulse systems rely upon diverting a portion of the mud flow through the wall of the drill-pipe, which creates a reduction of pressure at surface. Positive pulse systems normally use some form of poppet valve to temporarily restrict flow through the drill-pipe, which creates an increase in pressure at surface. A third method employs equipment which is sometimes referred to as a 'siren' in which a rotating vane is used to generate pressure variations with a continuous frequency, but which nevertheless generates positive pressure pulses at surface.

Many previous methods have involved placing some, or all, of the apparatus in a probe, and locating the probe down the centre of the drill-pipe. This leads to inevitable wear and tear on the apparatus, primarily through the processes of erosion, and also often through excessive vibration experienced during the drilling operation. The vibrations are both a function of the flow of drilling mud through the drill-pipe, and also of the 'whiplash' effect of the rotating drill-pipe. The whiplash effect occurs through the tendency for what is called 'stick-slip', whereby the drill bit periodically jams or stalls and the drill string above then acts like a spring, storing up energy until the bit releases and spins around, often at speeds much greater than the apparent rpm at surface. The cost of operating MWD equipment is therefore often determined by the required flow rates and types of mud employed during the drilling process. Furthermore, as the pipe is obstructed by the MWD equipment, it is impossible to pass through other equipment such as is often required for a variety of purposes. Examples of this include logging tools for the method commonly referred to as 'through bit logging'. Other examples include the use of actuating devices (commonly balls of diameter around 1") for other downhole equipment, such as diverting valves, located below the MWD equipment.

The drilling of a wellbore, preparation of a wellbore for production, and subsequent intervention procedures in a well involve the use of a wide range of different equipment. For example, a drilled wellbore is lined with bore-lining tubing which serves a number of functions, including supporting the drilled rock formations. The bore-lining tubing comprises tubular pipe sections known as casing, which are coupled together end to end to form a casing string. A series of concentric casing strings are provided, and extend from a wellhead to desired depths within the wellbore. Other bore-lining tubing includes a liner, which again comprises tubular pipe sections coupled together end to end. In this instance, however, the liner does not extend back to the wellhead, but is tied-back and sealed to the deepest section of casing in the wellbore. A wide range of ancillary equipment is utilised both in running and locating such bore-lining tubing, and indeed in carrying out other, subsequent downhole procedures. Such includes centralisers for centralising the bore-lining tubing (and indeed other tubing strings) within the wellbore or another tubular; drift tools which are used to verify an internal diameter of a wellbore or tubular; production tubing which is used to convey wellbore fluids to surface; and strings of interconnected or continuous (coiled) tubing, used to convey a downhole tool into the wellbore for carrying out a particular function. Such downhole tools might include packers, valves, circulation tools and perforation tools, to name but a few.

There is a desire to provide information relating to downhole parameters pertinent to particular downhole procedures or functions, including but not limited to those described above. Such might facilitate the performance of a particular downhole procedure.

SUMMARY OF THE INVENTION

According to a first aspect of the present invention, there is provided apparatus for generating a fluid pressure pulse downhole, the apparatus comprising:

- an elongate, generally tubular housing defining an internal fluid flow passage and having a housing wall; and
- a device for selectively generating a fluid pressure pulse, the device located at least partly in a space provided in the wall of the tubular housing.

According to a second aspect of the present invention, there is provided apparatus for generating a fluid pressure pulse downhole, the apparatus comprising:

an elongate, generally tubular housing defining an internal fluid flow passage and having a housing wall; and a device for selectively generating a fluid pressure pulse, the device comprising a cartridge which can be releasably mounted substantially entirely or entirely within a space provided in the wall of the tubular housing;

wherein the internal fluid flow passage defined by the tubular housing is a primary fluid flow passage and the apparatus comprises a secondary fluid flow passage having an inlet which communicates with the primary fluid flow passage;

and wherein the cartridge houses a valve comprising a valve element and a valve seat, the valve being actuable to control fluid flow through the secondary fluid flow passage to selectively generate a fluid pressure pulse.

The present invention offers advantages over prior apparatus and methods in that locating the device for generating a fluid pressure pulse in a space in a wall of a tubular housing reduces exposure of the device to fluid flowing through the housing. Thus where, for example, the apparatus is provided as part of a string of tubing such as a drill string, in which drilling fluid flows down through the tubular housing, exposure of the device to the drilling fluid is limited. This reduces erosion of components of the apparatus, particularly the pulse generating device. Additionally, location of the device in a space provided in a wall of a tubular housing, which housing defines an internal fluid flow passage, facilitates passage of fluid or other downhole objects (such as downhole tools, or actuating devices such as balls or darts) along the fluid flow passage defined by the housing.

The cartridge may be located entirely within the space in that no part of the cartridge protrudes from the space, or substantially entirely within the space such that a majority of the cartridge may be located within the space. Any part of the cartridge which might protrude may not provide a significant restriction.

The device may be located such that it does not restrict the flow area of the internal fluid flow passage during use. The device may be located such that no part of the device resides within the internal fluid flow passage. The device may be entirely located within the space.

The tubular housing may comprise a single or unitary body defining the internal fluid flow passage. Alternatively, the housing may comprise a plurality of housing components or parts which together form the housing. The housing may comprise an outer housing part, which may define an outer surface of the housing, and an inner housing part, which may define the space. The inner housing part may define at least part of the internal fluid flow passage. The inner housing part may be located within the outer housing part, and may be releasably mountable within the outer housing part.

The space may be elongate, and may be a bore, passage or the like. The space may extend along part, or all, of a length of the tubular housing. The bore may be a blind bore. The bore may extend in an axial direction with respect to the housing. The bore may be disposed in side-by-side relation to the internal fluid flow passage. The bore may be disposed such that an axis of the bore is spaced laterally/radially from a central or main axis of the tubular housing. The bore may be disposed parallel to the fluid flow passage, such that an axis of the bore is disposed parallel to an axis of the flow passage. The space may be a recess, channel, groove or the like provided in a surface of the housing. The recess may be provided in an external surface of the tubular housing. This may facilitate access to the space from externally of the tool, for location of the device in the space and removal for maintenance/replacement.

The fluid flow passage may be a bore extending in a direction along a length of the tubular housing, and may be substantially cylindrical in cross-section. The fluid flow passage may be of a substantially uniform cross-section along a length thereof, or a shape of the fluid flow passage in cross-section, and/or a cross-sectional area of the passage, may vary along a length thereof. The tubular housing may comprise upper and lower joints by which the apparatus may be coupled to adjacent tubing sections, and one of the joints may be a female (box) type connection and the other one of the joints a male (pin) type connection. The male connection may describe an internal diameter which corresponds to an internal diameter of tubing to which the apparatus is to be coupled. A diameter and/or cross-sectional area of the internal fluid flow passage may be less than an internal diameter and/or cross-sectional area described by the male connection. The fluid flow passage may be located coaxially with a main axis of the tubular housing. The fluid flow passage may be non-coaxially located relative to a main axis of the tubular housing.

The internal fluid flow passage defined by the tubular housing may be a primary fluid flow passage, the apparatus may define a secondary fluid flow passage, and the device may control fluid flow through the secondary fluid flow passage to selectively generate a fluid pressure pulse. The secondary fluid flow passage may be defined by, or may pass through, the space. The device may define at least part of the secondary fluid flow passage. The device may be arranged such that fluid flow along the secondary fluid flow passage is normally prevented, and may be actuable to permit fluid flow along the secondary fluid flow passage to generate a pulse. It will be understood that the device will then generate a negative fluid pressure pulse, in that the increased flow area provided when the secondary fluid flow passage is opened will cause a reduction in the pressure of fluid in tubing coupled to the apparatus. Alternatively, the device may be arranged such that fluid flow along the secondary fluid flow passage is normally permitted, and may be actuable to prevent fluid flow along the secondary fluid flow passage to generate a pulse. The device may then generate a positive pressure pulse in that the reduction of the flow area caused by closing the secondary fluid flow passage will cause an increase in the pressure of fluid in tubing coupled to the apparatus. The device may be arranged to generate a plurality of fluid pressure pulses by selective opening and closing of the secondary fluid flow passage, and may be adapted to generate a train of fluid pressure pulses for transmitting data relating to a measured parameter or parameters to surface.

The secondary fluid flow passage may be a bypass flow passage. The secondary fluid flow passage may comprise an inlet which communicates with an interior of the tubular housing. The secondary fluid flow passage may comprise an outlet which communicates with an exterior of the tubular housing. The secondary fluid flow passage may be a bypass or circulation flow passage for bypass flow/circulation of fluid to an exterior of the apparatus, which may be to an annulus defined between an external surface of the tubular housing and a wall of a wellbore in which the apparatus is located. The inlet may open on to the primary fluid flow passage defined by the tubular housing and the outlet may open to an exterior of the tubular housing. Alternatively, the inlet and the outlet may both communicate with the interior of the tubular housing. The inlet may open on to a part of the tubular housing which is upstream of the outlet in normal use of the apparatus. The inlet and/or the outlet may be flow ports, and may be radially or axially extending flow ports. A flow restrictor such as a nozzle may be mounted in the flow port of the or each of the inlet and outlet, and the nozzle may take the form of a bit jet.

The device may comprise a main body which is insertable within the space, or which can be releasably mounted within the space and may take the form of a cartridge/an insertable cartridge. This may facilitate location of the device within the space. The device may be releasably mountable within the space. The device may be a pulser. The device may comprise a valve for controlling fluid flow to generate a pressure pulse. The valve may control fluid flow along/through the secondary fluid flow passage. The valve may be normally closed, and opened to generate a negative pulse; or normally open, and closed to generate a positive pulse. The valve may be electromechanically actuated such as by a solenoid or motor. The valve may be hydraulically actuated. The valve may comprise a valve element and a valve seat.

The apparatus may comprise a pressure balancing system for controlling the force required to actuate the valve. The pressure balancing system may account for the significantly higher pressures which are experienced downhole. The pressure balancing system may comprise a floating piston coupled (hydraulically) to the valve element, a face of the piston exposed to the same fluid pressure as a sealing face of the valve element, to balance the pressure acting on the sealing face of the valve element. The fluid pressure may be prevailing wellbore pressure, the pressure of fluid in the main fluid flow passage or some other pressure. The valve element sealing face may be adapted to abut the valve seat and may be exposed to prevailing wellbore pressure (or some other pressure of fluid external to the apparatus or an internal pressure) when the valve is closed. The valve element may comprise a rear face. The pressure balancing system may comprise a floating piston having a front face which is exposed to the prevailing wellbore pressure (or other pressure) when the valve is closed, and a rear face which is in fluid communication with the rear face of the valve element to transmit the prevailing wellbore pressure to the rear face of the valve element and thereby balance a fluid pressure force acting on the sealing face of the valve element. The valve seat may define a bore having a first area, the floating piston may be mounted in a cylinder having a bore defining a second area and the valve element may be mounted in a cylinder having a bore defining a third area. The first, second and third areas may be substantially the same such that a pressure balancing force exerted on the rear face of the valve element is substantially the same or the same as a fluid pressure force acting on the sealing face of the valve element. The valve seat bore, the bore of the floating piston cylinder and the bore of the valve element cylinder may be of the same or substantially similar dimensions and may be the same diameters.

The device may comprise a power generating arrangement/energy harvesting arrangement for generating electrical energy downhole to provide power for at least part of the device. The power generating arrangement may, in particular, provide power for actuating the valve to control fluid flow along the secondary fluid flow passage. However, it will be understood that the power generating arrangement may provide power for other components of the device. The power generating arrangement may be adapted to convert kinetic energy into electrical energy for providing power. The power generating arrangement may comprise a generator having a rotor and a stator. The rotor may comprise or may be coupled to a body which is arranged such that, on rotation of the apparatus, the body will rotate relative to the stator and thus drive the rotor relative to the stator to generate electrical energy. This may facilitate utilisation of the mechanical forces exerted upon the apparatus during use, particularly where the apparatus is provided in a drill string and is rotated. Power generation may be enhanced by locating the space displaced laterally from a main axis of the tubular housing. The body may be eccentrically mounted on or with respect to the rotor shaft, and/or the body may be shaped such that a distance between an external surface or extent of the body and the rotor shaft is non-uniform in a direction around a circumference of the rotor shaft. The body may be an unbalanced mass. The body may be an eccentric body, and may be generally cam-shaped. The body may comprise at least one lobe. The device may comprise an onboard source of electrical energy such as a battery or battery pack comprising a plurality of batteries.

The device may comprise a sealing member or element for closing the secondary fluid flow passage. The sealing member may be selectively actuable to close the secondary fluid flow passage. The sealing member may close the secondary fluid flow passage by closing the inlet. The sealing member may be a sleeve, and the sleeve may be actuable to move from a position where the inlet port of the secondary fluid flow passage is open and a position where the inlet port is closed, and may be actuable independently of the valve. The sealing member may be a plug, ball, dart or the like which can be inserted into the fluid flow passage. It may be possible to re-establish flow after the sleeve has been moved to the closed position. The sealing member may be externally actuable, such as in the case of a sleeve which may be actuated by a shifting tool, or by an actuating element which may be a dart or a ball. The sealing member may be internally actuable, controlled by the apparatus. For example, the apparatus may be actuable in response to a hydraulic signal from surface to cause the sealing member to move between open and closed and/or closed and open positions.

The apparatus may be for generating fluid pressure pulses to transmit data concerning at least one measured downhole parameter to surface. The apparatus may comprise at least one sensor. The apparatus may comprise at least one orientation sensor. The apparatus may comprise at least one geological sensor. The apparatus may comprise at least one physical sensor. The device, in particular the cartridge, may comprise the or each sensor, or the sensors may be provided separately from the device and may be located in the space. The orientation sensor or sensors may be selected from the group comprising an inclinometer; a magnetometer; and a gyroscopic sensor. The geological sensor or sensors may be selected from the group comprising a gamma sensor; a resistivity sensor; and a density sensor. In the case of a gamma sensor, location of the device in a space which is provided off-centre or spaced laterally from a main axis of the tubular housing may improve the sensitivity of the measurements taken. This is due to the wall thickness of the tubular housing through which the gamma rays must pass being reduced (at least in one direction) compared to gamma sensors in prior apparatus and methods. In addition, this off-centre positioning will facilitate provision of an azimuth reading as the gamma sensor will be more sensitive to measurements taken in the direction passing through the minimum wall thickness of the tubular housing. The physical sensor or sensors may be selected from the group comprising sensors for measuring temperature; pressure;

acceleration; and strain parameters. Strain parameters may give rise to measurements of torque and weight.

The apparatus may be adapted to be provided in or as part of a drill string and coupled to a section or sections of drill pipe or other components of a drill string. The apparatus may be an MWD apparatus, or may form part of an MWD assembly. The apparatus may be adapted to be provided in or as part of a completion tubing string, which may be a production tubing string through which well fluids are recovered to surface, and may be coupled to a section or sections of production tubing. Where the apparatus is to be provided in or as part of a completion tubing string (or other tubing string), the apparatus may comprise at least one sensor for taking force measurements relating to the compressive and/or torsional loading on the completion tubing during use. The apparatus may be adapted to be provided as part of a wellbore-lining tubing string, which may be a casing or a liner, and may be adapted to be provided in a section of casing or liner tubing, a casing or liner coupling or joint, a pup joint (a section of casing or liner of shorter length than a length of a remainder or majority of sections in the string), and/or a casing shoe. The casing shoe may be a reamer casing shoe carrying a reamer, which may be adapted to be rotated from surface or by a drilling motor provided in a string of casing carrying the reamer. The motor may be a positive displacement motor (PDM), turbine or any other device capable of inducing rotation. The apparatus may be adapted to be provided as part of any other suitable downhole tubing string, which may comprise a tool string (which may be a string of tubing adapted for carrying a downhole tool into a wellbore for performing a downhole function); or a string for conveying a fluid into or out of a well. The apparatus may be adapted to be provided as part of a centraliser or stabiliser; a drift component; a body comprising a number of channels in a surface for fluid bypass, which may be flutes and in which the space is defined by one of the flutes; a turbo casing reamer shoe; and/or any other suitable section of tubing/tubular member or downhole tool/downhole tool component.

The apparatus for generating a fluid pressure pulse of the second aspect of the invention may include any of the features, options or possibilities set out elsewhere in this document, particularly in and/or in relation to the first aspect of the invention.

According to a third aspect of the present invention, there is provided a downhole assembly comprising:

- a first apparatus for generating a fluid pressure pulse downhole; and
- at least one further apparatus for generating a fluid pressure pulse downhole;
- wherein the first and the at least one further downhole apparatus each comprise an elongate, generally tubular housing defining an internal fluid flow passage and having a housing wall; and a device for selectively generating a fluid pressure pulse, the device located at least partly in a space provided in the wall of the tubular housing.

According to a fourth aspect of the present invention, there is provided a downhole assembly comprising:

- a first apparatus for generating a fluid pressure pulse downhole, comprising at least one sensor for measuring at least one downhole parameter in a region of the first apparatus, the apparatus arranged to transmit data concerning the at least one measured downhole parameter to surface; and
- at least one further apparatus for generating a fluid pressure pulse downhole, the at least one further apparatus spaced along a length of the assembly from the first apparatus and comprising at least one sensor for measuring at least one downhole parameter in a region of the further apparatus, the apparatus arranged to transmit data concerning the at least one measured downhole parameter to surface;
- wherein the first and the at least one further downhole apparatus each further comprise an elongate, generally tubular housing defining an internal fluid flow passage and having a housing wall; and a device for selectively generating a fluid pressure pulse, the device located at least partly in a space provided in the wall of the tubular housing.

The first apparatus and the at least one further apparatus of the downhole assembly of the third and fourth aspects of the invention may be the apparatus for generating a fluid pressure pulse downhole of the first or second aspects of the invention. Further features of the first apparatus and the at least one further apparatus of the downhole assembly of the third and fourth aspects of the present invention are defined above with respect to the first and/or second aspect of the present invention.

The first and the at least one further apparatus may be spaced apart and may be coupled together by downhole tubing. Alternatively, the first and the at least one further apparatus may be directly coupled together. Provision of a first and an at least one further apparatus may facilitate generation of fluid pressure pulses relating to downhole parameters measured at spaced locations within a wellbore.

The assembly may comprise a second apparatus for generating a fluid pressure pulse downhole and a third such apparatus. Further such apparatus may be provided.

The downhole assembly may be a drilling assembly comprising a string of drill pipe carrying the first and the at least one further apparatus. The first and the at least one further apparatus may each take the form of an MWD apparatus for transmitting data relating to measured downhole parameters to surface.

The downhole assembly may be a completion assembly and may comprise a string of production tubing carrying the first and the at least one further apparatus. The first and the at least one further apparatus may be for transmitting data relating to compressive and/or torsional loading on, or experienced by, the production tubing to surface.

The assembly may be a wellbore-lining tubing string, which may be a casing or a liner. The first and/or further apparatus may be provided in a section of casing or liner tubing, a casing or liner coupling or joint, a pup joint (a section of casing or liner of shorter length than a length of a remainder or majority of sections in the string), and/or a casing shoe. The casing shoe may be a reamer casing shoe carrying a reamer, which may be adapted to be rotated from surface or by a drilling motor provided in a string of casing carrying the reamer.

The assembly may be any other suitable downhole tubing string, which may comprise a tool string (which may be a string of tubing adapted for carrying a downhole tool into a wellbore for performing a downhole function); or a string for conveying a fluid into or out of a well.

The first and/or further apparatus may be provided as part of or in a centraliser or stabiliser; a drift tool or component; a body comprising a number of channels in a surface for fluid bypass, which may be flutes and in which the space is defined by one of the flutes; a turbo casing reamer shoe; and/or any other suitable section of tubing/tubular member or downhole tool/downhole tool component.

According to a fifth aspect of the present invention, there is provided a device for selectively generating a fluid pressure pulse downhole, the device adapted to be located in a space provided in a wall of an elongate, generally tubular housing which defines an internal fluid flow passage.

The device may be releasably mountable within the space.

According to a sixth aspect of the present invention, there is provided a device for selectively generating a fluid pressure pulse downhole, the device comprising a cartridge which can be releasably mounted entirely within a space provided in a wall of an elongate, generally tubular housing which defines an internal fluid flow passage;

wherein the internal fluid flow passage defined by the tubular housing is a primary fluid flow passage and the device defines at least part of a secondary fluid flow passage having an inlet which can communicate with the primary fluid flow passage;

and wherein the cartridge houses a valve comprising a valve element and a valve seat, the valve being actuable to control fluid flow through the secondary fluid flow passage to selectively generate a fluid pressure pulse.

Further features of the device of the fifth and sixth aspects of the present invention are defined above in/with respect to the first and/or second aspects of the invention.

The apparatus for generating a fluid pressure pulse of the fifth and/or sixth aspects of the invention may include any of the features, options or possibilities set out elsewhere in this document, particularly in and/or in relation to the first and/or second aspects of the invention.

According to a seventh aspect of the present invention, there is provided a method of generating a fluid pressure pulse downhole, the method comprising the steps of:

locating a device for selectively generating a fluid pressure pulse in a space provided in a wall of an elongate, generally tubular housing which defines an internal fluid flow passage; and selectively actuating the device to generate a pressure pulse.

According to an eighth aspect of the present invention, there is provided a method of generating a fluid pressure pulse downhole, the method comprising the steps of:

releasably mounting a cartridge of a device for selectively generating a fluid pressure pulse entirely within a space provided in a wall of an elongate, generally tubular housing which defines a primary internal fluid flow passage, the cartridge housing a valve comprising a valve element and a valve seat; and selectively actuating the device to control fluid flow through a secondary fluid flow passage having an inlet which communicates with the primary fluid flow passage, to generate a fluid pressure pulse.

The method may comprise locating the device such that it does not restrict the flow area of the internal fluid flow passage during use, and may comprise locating the device such that no part of the device resides within the internal fluid flow passage.

The method may comprise directing fluid through the internal fluid flow passage defined by the tubular housing, and selectively actuating the device to control fluid flow through a secondary fluid flow passage to selectively generate a fluid pressure pulse. The method may comprise arranging the device such that fluid flow along the secondary fluid flow passage is normally prevented, and actuating the device to permit fluid flow along the secondary fluid flow passage to generate a pulse. Alternatively, the method may comprise arranging the device such that fluid flow along the secondary fluid flow passage is normally permitted, and actuating the device to prevent fluid flow along the secondary fluid flow passage to generate a pulse. The method may comprise generating a plurality of fluid pressure pulses, by selectively opening and closing the secondary fluid flow passage.

The method may comprise selectively actuating the device to direct fluid flow to an exterior of the housing to generate a pressure pulse. Alternatively, the method may comprise selectively actuating the device to permit fluid flow from an inlet to an outlet, the inlet and the outlet both communicating with the interior of the tubular housing. The inlet may open on to a part of the tubular housing which is upstream of the outlet in normal use of the apparatus.

The method may comprise releasably mounting the device within the space. The method may comprise selectively actuating a valve of the device for controlling fluid flow to generate a pressure pulse.

The method may comprise generating electrical energy downhole utilising a power generating arrangement/energy harvesting arrangement. The power generating arrangement may, in particular, provide power for actuating the valve to control fluid flow along the secondary fluid flow passage. However, it will be understood that the power generating arrangement may provide power for other components of the device. The method may comprise converting kinetic energy into electrical energy for providing power.

The method may comprise transmitting data concerning at least one measured downhole parameter to surface utilising the device. The method may comprise measuring at least one downhole parameter selected from the group comprising at least one orientation parameter; at least one geological parameter; and at least one physical parameter.

The method may comprise releasably mounting a cartridge of a first device for selectively generating a fluid pressure pulse entirely within a space provided in a wall of a first elongate, generally tubular housing; mounting at least one further device for selectively generating a fluid pressure pulse entirely within a space provided in a wall of an at least one further elongate, generally tubular housing; providing the housings in a string of tubing and locating the string of tubing in a wellbore; measuring at least one downhole parameter in a region of the first device using at least one sensor of the first device; measuring at least one downhole parameter in a region of the further device using at least one sensor of the further device; and actuating the devices to transmit data concerning the measured downhole parameters to surface. The method may therefore permit the transmission of data relating to parameters measured at spaced locations within a wellbore to surface. The method may comprise mounting the apparatus in a drill string and utilising the drill string to drill a borehole. The method may comprise measuring at least one downhole parameter and transmitting data relating to the measured parameter to surface using the device whilst drilling the wellbore.

The method may comprise mounting the apparatus in a completion tubing string, which may be a production tubing string, locating the completion tubing in a wellbore and recovering well fluids to surface. The method may comprise measuring at least one downhole parameter and transmitting data relating to the measured parameter to surface using the device whilst recovering well fluids to surface.

The method may comprise mounting the device in a wellbore-lining tubing string, which may be a casing or a liner and locating the wellbore lining tubing string in a wellbore. The method may comprise measuring at least one downhole parameter and transmitting data relating to the measured parameter to surface using the device following location of the tubing string in the wellbore. The method may comprise providing the device in a section of casing or liner tubing, a casing or liner coupling or joint, a pup joint (a section of casing or liner of shorter length than a length of a remainder or majority of sections in the string), and/or a casing shoe. The casing shoe may be a reamer casing shoe carrying a reamer, which may be adapted to be rotated from surface or by a drilling motor provided in a string of casing carrying the reamer. The method may comprise performing a reaming operation and transmitting date relating to a parameter measured during the reaming operation to surface.

The method may comprise mounting the device in any other suitable downhole tubing string, which may comprise a tool string (which may be a string of tubing adapted for carrying a downhole tool into a wellbore for performing a downhole function); or a string for conveying a fluid into or out of a well.

The method may comprise mounting the device in a centraliser or stabiliser; a drift component; a body comprising a number of channels in a surface for fluid bypass, which may be flutes and in which the space is defined by one of the flutes; a turbo casing reamer shoe; and/or any other suitable section of tubing/tubular member or downhole tool/downhole tool component.

The method of generating a fluid pressure pulse of the eighth aspect of the invention may include any of the features, options or possibilities set out elsewhere in this document, particularly in and/or in relation to the seventh aspect of the invention.

According to a ninth aspect of the present invention, there is provided a method of transmitting data relating to a plurality of downhole parameters to surface, the method comprising the steps of:

- mounting a first device for generating a fluid pressure pulse within a space provided in a wall of a first elongate generally tubular housing which defines an internal fluid flow passage;
- mounting at least one further device for generating a fluid pressure pulse within a space provided in a wall of a further elongate generally tubular housing which defines an internal fluid flow passage;
- providing the first and further housings in a string of downhole tubing and locating the string of tubing in a wellbore;
- measuring at least one downhole parameter in a region of the first device using at least one sensor of the first device;
- measuring at least one downhole parameter in a region of the further device using at least one sensor of the further device; and
- actuating the devices to transmit data concerning the measured downhole parameters to surface.

The method may be a method of verifying the temperature and/or pressure of a wellbore prior to, and/or during, a cementing, fracturing or stimulating operation. The method may be a method of verifying the alignment of windows in a wellbore lining tubing of a multilateral wellbore lining system, wherein one or both of the first and at least one further devices are provided in a wall of a section of wellbore lining tubing comprising at least one window in a wall thereof and through which a lateral wellbore may be drilled. The measured parameter may relate to a position of the wellbore lining tubing within the wellbore and thus of the window. An or each sensor may detect a position of a window of the respective tubing section relative to the high side of the wellbore (in the case of a deviated wellbore) and/or azimuth of the section so that data relating to the position of the window can be derived.

The housings may be spaced along a length of the string of downhole tubing.

The method of transmitting data relating to a plurality of downhole parameters to surface, involving the generation of fluid pressure pulses, may include any of the features, options or possibilities set out elsewhere in this document, particularly in and/or in relation to the seventh and/or eighth aspects of the invention.

According to a tenth aspect of the present invention, there is provided a power generating arrangement for a downhole device, for generating electrical energy in a downhole environment to provide power for the device, the power generating arrangement comprising:

- a generator having a rotor and a stator; and
- a body coupled to the rotor and which is arranged such that, on rotation of the device, the body will rotate relative to the stator to drive and rotate the rotor relative to the stator to generate electrical energy.

The device may be rotated, in use, relative to a wellbore or borehole in which the device is located.

The power generating arrangement may be adapted to convert kinetic energy into electrical energy for providing power. The body may be eccentrically mounted on or with respect to the rotor shaft, and/or the body may be shaped such that a distance between an external surface or extent of the body and the rotor shaft is non-uniform in a direction around a circumference of the rotor shaft. The body may be an unbalanced mass. The body may be an eccentric body, and may be generally cam-shaped. The body may comprise at least one lobe.

According to an eleventh aspect of the present invention, there is provided a downhole assembly comprising apparatus for generating a fluid pressure pulse downhole according to the first or second aspect of the present invention.

Further features of the apparatus forming part of the assembly of the eleventh aspect of the present invention are defined with respect to the first and/or second aspects of the invention.

In a twelfth aspect of the invention, there is provided a wellbore-lining tubing comprising:

- a tubing wall, an internal fluid flow passage, and at least one window pre-formed in the wall of the tubing;
- a device for selectively generating a fluid pressure pulse, the device located at least partly in a space provided in the wall of the tubing; and
- a coupling for receiving a deflection tool so that the deflection tool can be secured to the tubing and employed to divert a downhole component through the window in the tubing wall.

In the oil and gas exploration and production industry, lateral well drilling techniques have been developed in which lateral wellbores are drilled from a main wellbore which extends to surface. The advantage of such techniques is that access to multiple wells, or multiple zones in a particular well, can be obtained via a single main wellbore drilled from surface. The main wellbore is lined with wellbore-lining tubing in the form of a casing which extends to a wellhead at surface, and optionally a liner, following the procedure discussed above. Prior techniques involved the location of a deflection tool known as a whipstock in the casing/liner, at the location where a lateral wellbore is to be drilled. The deflection tool has a hardened face which deflects a drilling/milling tool out through the wall of the casing/liner, to drill a lateral wellbore.

Difficulties associated with such techniques included accurate positioning of the deflection tool at the required location downhole, which may be many thousands of feet from surface. Accordingly, developments of these techniques involved providing a wellbore-lining tubing, such as a casing or liner, with a pre-formed window. The casing/liner is run into the wellbore with the window in the desired rotational position (azimuth), and located at the required depth in the wellbore. However, it is necessary to verify at least the rotational position (and optionally depth) of the window prior to commencement of drilling of the lateral wellbore. Such is particularly necessary to account for torque applied to the casing/liner during make-up and running into the wellbore, which can result in the window being rotationally displaced from its intended position. Also, it can be difficult to accurately position the window at the required depth, particularly in a deviated wellbore.

To this end, it has been known to provide an assembly comprising a wellbore-lining tubing including a pre-formed window; a latch coupling for a deflection tool; an inner tubing string coupled to the wellbore-lining tubing; and a fluid pressure pulse generating device (e.g. an MWD device) positioned centrally in a bore of the inner tubing string. The position and rotational orientation of the inner string relative to the wellbore-lining tubing, and so of the pulse generating device relative to the window, is known prior to deployment in the well. In this way, the pulse generating device is employed to transmit data to surface relating to the rotational orientation (and optionally also depth) of the window in the wellbore. Wellbore-lining tubing comprising a pre-formed window, suitable for use in such techniques, is commercially available from Halliburton Corporation under the FlexRite® Trade Mark. Whilst this was a significant improvement on the prior techniques discussed above, there remain certain significant disadvantages.

In particular, running the inner string to deploy the pulse generating device to perform the orientation creates several problems.

Firstly, the main bore of the tubing is restricted by the pulse generating device, which is generally undesirable.

Secondly, a conventional cement job cannot be carried out to cement the wellbore-lining tubing, because the pulse generating device must be isolated before cement can be supplied into the wellbore. This is because the device employs drilling fluid (mud) or the like for pulsing data to surface; it cannot operate on cement, and the cement would further cause irreparable harm to internal workings of the device. Accordingly, following operation of the pulse generating device to transmit data about window position/depth to surface, the prior technique requires that a plug be positioned in the wellbore above the device, to isolate it from cement which is charged into the wellbore-lining tubing. The plug is used to open a bypass to annulus above the device, so that the cement can bypass around the device. The result of this is that the cement is then unfortunately contaminated with any drilling fluids remaining in the bypass volume, which might typically amount to 1 to 3 cubic meters. Contamination of the cement is to be avoided, especially in scenarios in which the cement forms a primary barrier for hydraulically sealing the annular region between the wellbore-lining tubing and the wall of the wellbore.

Thirdly, the inner tubing string and pulse generating device tool has a weight associated with it. Surface facilities (rigs) which are employed to deploy the equipment into the well have maximum weight capacities that can safety be handled by the rig running gear. Much of this is taken up by the inner string and pulse generating device, which must be removed following completion of the procedure, and thus which does not form part of the well completion.

Fourthly, running and indeed subsequent pulling of the inner string uses up substantial rig time, with an associated impact on costs. Furthermore, there is a significant health & safety issue associated with handling of the inner tubing string. In particular, the running of multilateral 'junctions' (windowed casing/liner), and subsequent drilling and lining of the multilaterals, results in a significant period of time during which the wellbores remain uncompleted, that is the drilled wellbores cannot be lined and cemented for a significant period of time. This raises the possibility of formation degradation in the wellbores occurring before they can be lined and cemented.

The invention of this aspect of the invention provides the ability to address all of these problems. In particular, providing wellbore-lining tubing with a device for generating a fluid pressure pulse located at least partly in a space provided in the wall of the tubing provides the following benefits. It potentially avoids restriction of the tubing bore. It permits a more conventional cement job to be carried out (there is no need to isolate the device from cement, as it remains within the wellbore, forming part of the completion). Operation of the device avoids contamination of the cement (any drilling or like fluids are in the annular region between the tubing and the wellbore wall, above or uphole of cement which is charged into the annular region, and so urged towards surface along the annular region ahead of the cement). It avoids the requirement to provide a dedicated inner tubing string, with consequent weight savings; this permits longer (i.e. heavier) multilateral completion strings of wellbore-lining tubing to be run, and also reduces rig time, by perhaps as much as 8 to 16 hours (with consequent benefits in terms of cost savings and safety improvements).

It will be understood that, whilst the window is pre-formed in the material of the tubing, it is necessary to close off the window to enable various downhole procedures to be performed. Such includes, but is not limited to, cementation of the tubing and operation of the pulse generating device. The window may be closed off by a sleeve or the like which is of a material having a higher hardness than that of the tubing, and so which is easily milled or drilled out. For example, the tubing may be of a steel and the sleeve of an aluminium alloy. The window may be provided in the tubing integrally with the pulse generating device and the coupling. In other words, a single tubing (or single tubing section where the tubing is made up of a plurality of tubing sections coupled together) may be provided which comprises the window, the pulse generating device located in the space in the wall of the tubing, and the coupling. This is advantageous in that all of the components can be provided in a single tubing (or tubing section), facilitating make-up and running of the tubing. The window may be pre-formed by a material removal process such as a milling process. However, other suitable processes may be employed to pre-form the window. It will be understood that the window is pre-formed in that it is formed prior to deployment of the tubing into the wellbore, rather than downhole, following prior multi-lateral techniques.

Optionally however, the window, pulse generating device and/or the coupling may be provided in separate tubing sections which form part of the tubing. For example, a first tubing section of the tubing may comprise the window; a second tubing section may comprise the space with the pulse generating device located at least partly in the space; and a third tubing section may comprise the coupling for the deflection tool. The tubing sections may be coupled together end to end, or spaced apart by at least one further tubing section, in appropriate circumstances. One tubing section may comprise at least two of the window, space/pulse generating device and coupling.

The device for selectively generating a fluid pressure pulse may comprise a cartridge which can be releasably mounted substantially entirely or entirely within the space in the wall of the tubing; the internal fluid flow passage defined by the tubing may be a primary fluid flow passage, and the device may define a secondary fluid flow passage having an inlet which communicates with the primary fluid flow passage; and the cartridge may house a valve comprising a valve element and a valve seat, the valve being actuable to control fluid flow through the secondary fluid flow passage to selectively generate a fluid pressure pulse.

The tubing may be capable of being employed in a casing drilling procedure, and may comprise a drilling, milling and/or reamer device, such as casing reamer shoe. The tubing, or at least part of the tubing, may be rotated to advance or enlarge the main wellbore.

The coupling may be a latch coupling to which the deflection tool can be releasably latched, for securement of the deflection tool to the tubing. The deflection tool may be positioned within the internal passage of the tubing. The latch coupling may take the form of a profile such as a recess, channel, groove or the like formed in the wall of the tubing, and which is engaged by suitable engaging elements such as dogs on the deflection tool. However, the latch coupling may define an upset and may be a ring or shoulder which the deflection tool can seat on and latch to. The coupling may be arranged so that it receives the deflection tool in a discrete or predetermined orientation, which may be a rotational orientation of the deflection tool. In this way, the deflection tool may only be capable of being secured to the coupling in the discrete/predetermined position, to ensure correct rotational orientation of the deflection tool. Optionally, a plurality of discrete positions for the deflection tool may be defined.

The tubing may be arranged so that fluid can flow from the tubing into the wellbore through an opening at a downhole end of the tubing. A shoe, such as a cement shoe, may be provided at the downhole end for permitting fluid to flow out of the tubing into the wellbore, and which may optionally prevent fluid returns.

The tubing may be closed or closable at a downhole end thereof, to prevent fluid flow from the tubing into the wellbore. The tubing may be plugged at the downhole end, for example via a drillable plug which can be drilled out to open fluid communication and/or to extend the main wellbore. In this scenario, it may be necessary to promote a pressure differential between fluid in the internal flow passage and the exterior of the tubing, such being employed to generate fluid pressure pulses by means of opening flow to the exterior of the tubing using the pulse generating device. Such may be in accordance with the teachings of International Patent Publication No. WO-2011/036471, the disclosure of which is incorporated herein by way of reference.

Further features of the device forming part of the tubing of the twelfth aspect of the present invention are defined with respect to the first and/or second aspects of the invention.

In a thirteenth aspect of the invention, there is provided a method of forming a lateral wellbore, the method comprising the steps of:

drilling a main wellbore;

locating a wellbore-lining tubing in the main wellbore, the tubing having:

a tubing wall, an internal fluid flow passage, and at least one window pre-formed in the wall of the tubing;

a device for selectively generating a fluid pressure pulse located at least partly in a space provided in the wall of the tubing; and a coupling for receiving a deflection tool;

following location of the tubing in the main wellbore, activating the fluid pressure pulse generating device to generate pressure pulses for transmitting data relating to the rotational orientation of the tubing window in the main wellbore to surface;

securing a deflection tool to the tubing using the coupling; and employing the deflection tool to divert a downhole component through the window in the tubing wall.

Rotational orientation (azimuth) may be determined using an appropriate sensor or sensors. A sensor may be provided for detecting a position of the window relative to the high side of the wellbore (in the case of a deviated wellbore). The device may transmit data relating to the depth of the window in the main wellbore to surface. Depth may be determined using an appropriate sensor, which detects the presence of a feature which is at a known depth in the wellbore. The feature may be a geological feature. The feature may be a feature of another tubing or downhole component. For example, a casing collar locator (CCL) may be provided for detecting collars between sections of another tubing in which the tubing of this aspect of the invention is positioned. The depth of the collars in the wellbore is known, facilitating determination of depth by counting the collars.

The method may be a multilateral wellbore forming method, involving forming a plurality of lateral wellbores. The wellbore-lining tubing may comprise a plurality of pre-formed windows, each associated with a respective lateral wellbore. There may be a plurality of couplings, each associated with a respective lateral wellbore. There may be a plurality of pulse generating devices, each associated with a respective lateral wellbore. Optionally, the pulse generating device may be associated with a plurality of lateral wellbores; this may facilitate the transmission of data relating to a plurality of lateral wellbores to surface employing a single pulse generating device.

The transmission of data to surface relating to rotational orientation (and optionally also depth) of the window may facilitate verification of the orientation/depth prior to deflection of the downhole component through the window. This may be of particular importance where a lateral wellbore is to be drilled through the window, in that it helps to ensure the correct kick-off of the lateral from the main wellbore.

The downhole component may be a drilling, milling and/or reaming tool for drilling and extending the lateral wellbore. Thus the method may involve the drilling of a lateral wellbore through the window.

The downhole component may be a wellbore-lining tubing such as a liner to be installed in a lateral wellbore extending from the window. Thus the method may involve the lining of the lateral wellbore. The method may involve both drilling and lining of the lateral wellbore.

The method may comprise the further step of cementing the wellbore-lining tubing in the main wellbore. This step will typically be carried out following drilling and lining of the lateral wellbore, and so following transmission of the data to surface. The cement may be supplied into the annular region between the tubing and a wall of the wellbore (or optionally between the tubing and another larger diameter tubing in which it is located) at a location which is downhole of the pulse generating device. Optionally the cement may be supplied through a downhole end of the tubing, such as through a cement shoe.

The downhole component may be a component which is to be run into a lateral wellbore extending from the window following drilling and lining of the lateral wellbore. Such might include, but is not limited to, intervention or workover equipment.

The method may comprise closing a downhole end of the tubing, to prevent fluid flow from the tubing into the wellbore. The method may comprise plugging the downhole end of the tubing, for example via a drillable plug, and drilling the plug out to open fluid communication and/or to extend the main wellbore. The method may comprise raising the pressure of fluid in the internal flow passage of the tubing relative to the pressure of fluid externally of the tubing, and employing the pressure differential to generate fluid pressure pulses by means of opening flow to the exterior of the tubing using the pulse generating device. Such may be in accordance with WO-2011/036471.

Further feature of the method of the thirteenth aspect of the invention may be derived from the text above relating to the tubing of the twelfth aspect.

BRIEF DESCRIPTION OF THE DRAWINGS

Embodiments of the present invention will now be described, by way of example only, with reference to the accompanying drawings, in which.

DETAILED DESCRIPTION OF THE INVENTION

Figure 1:
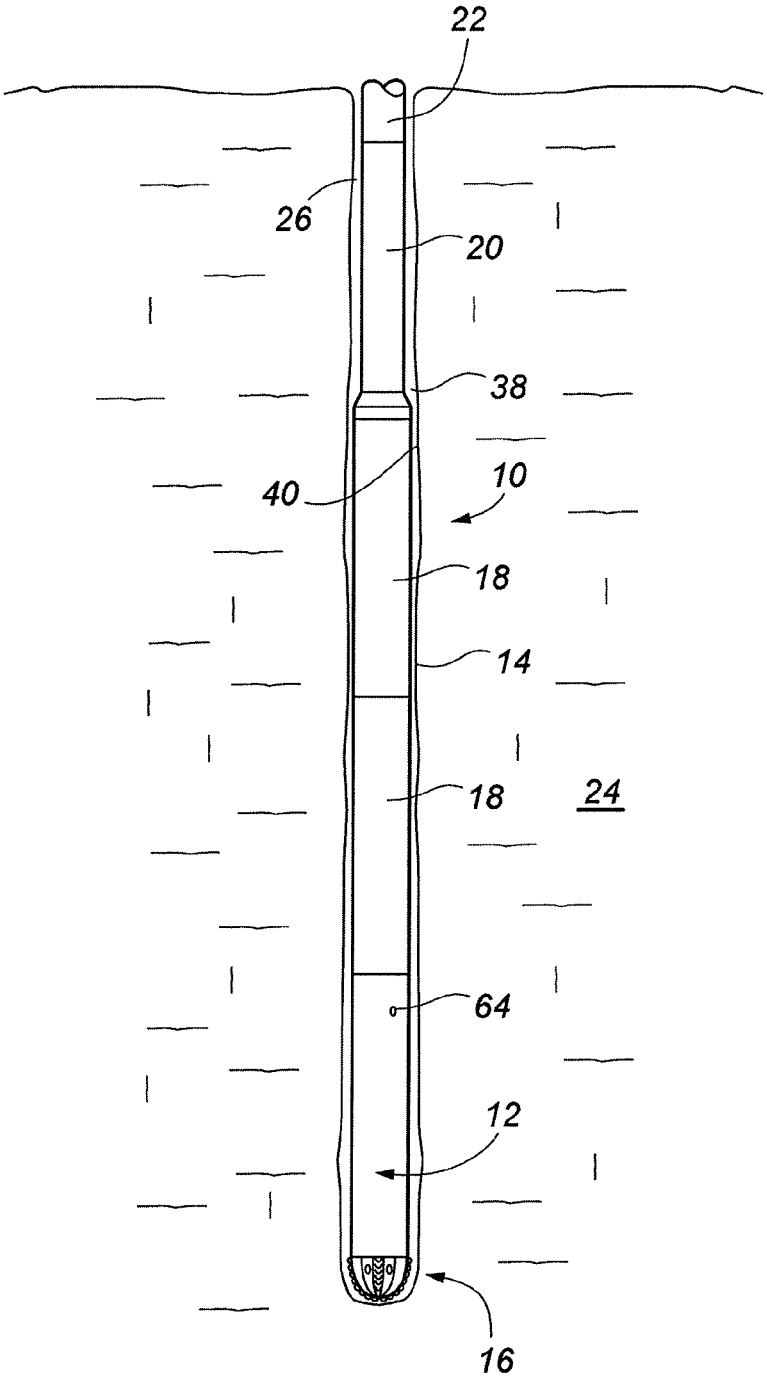
FIG. 1 is a schematic view of a downhole assembly, comprising apparatus for generating a fluid pressure pulse downhole, in accordance with an embodiment of the present invention and which is shown in use, during drilling of a borehole.

Turning firstly to FIG. 1, there is shown a downhole assembly which is indicated generally by reference numeral 10, the assembly comprising an apparatus for generating a fluid pressure pulse downhole in accordance with an embodiment of the present invention and which is indicated generally by reference numeral 12. As will be described in more detail below, the apparatus 12 has a particular utility in transmitting data relating to one or more parameters measured in a downhole environment to surface.

In the illustrated embodiment, the assembly 10 takes the form of a drill string and is shown in use, during the drilling of a wellbore or borehole 14. The drill string 10 comprises a drill bit 16 at a lower end and a number of drill collars (two shown and each given the reference numeral 18) which are provided above the bit. The drill collars 18 are of a conventional construction, and are relatively thick-walled tubing sections which are utilised to apply weight to the bit 16 to assist in drilling the wellbore 14. The apparatus 12 takes the form of a MWD tool and is provided in the drill string in the region of the drill collars 18, typically located below the drill collars and coupled to the drill bit 16. The MWD tool 12 has an outer diameter which is equivalent to that of the drill collars 18.

Positioning the MWD tool 12 as close as possible to the drill bit 16 offers certain advantages, which will be discussed below. Also, positioning the MWD tool 12 in the region of the string 10 carrying the collars 18 provides the greatest possible wall thickness for the tool, which again offers certain advantages that will be discussed below. The assembly of the MWD tool 12, drill collars 18 and drill bit 16 is suspended from a rig (not shown) by means of a series of interconnected drill pipe sections, one of which is shown and given the reference numeral 22. The drill pipe sections 22 are coupled together end-to-end in a conventional fashion and coupled to the upper drill collar 18 using a suitable pipe section 20. The wellbore 14 is drilled by rotating the entire drill string 10, using a rotary table or top drive on the rig. It will be understood that references to 'upper' and 'lower' components or positions are relative to the borehole in question. A lower position should generally be taken to be one which is deeper in the borehole 14, in use.

As will be understood by persons skilled in the art, the wellbore 14 is a substantially vertical wellbore in which the weight of the drill collars 18 can be utilised to assist in penetrating the rock formations 24 which are to be drilled. However, in the case of a deviated well, a drilling motor such as a mud motor (not shown) may be mounted above the bit 16 and used to drive and rotate the drill bit to penetrate the rock formations 24. In this case, the drill string 10 carrying the mud motor would not be rotated from surface.

Figure 2:
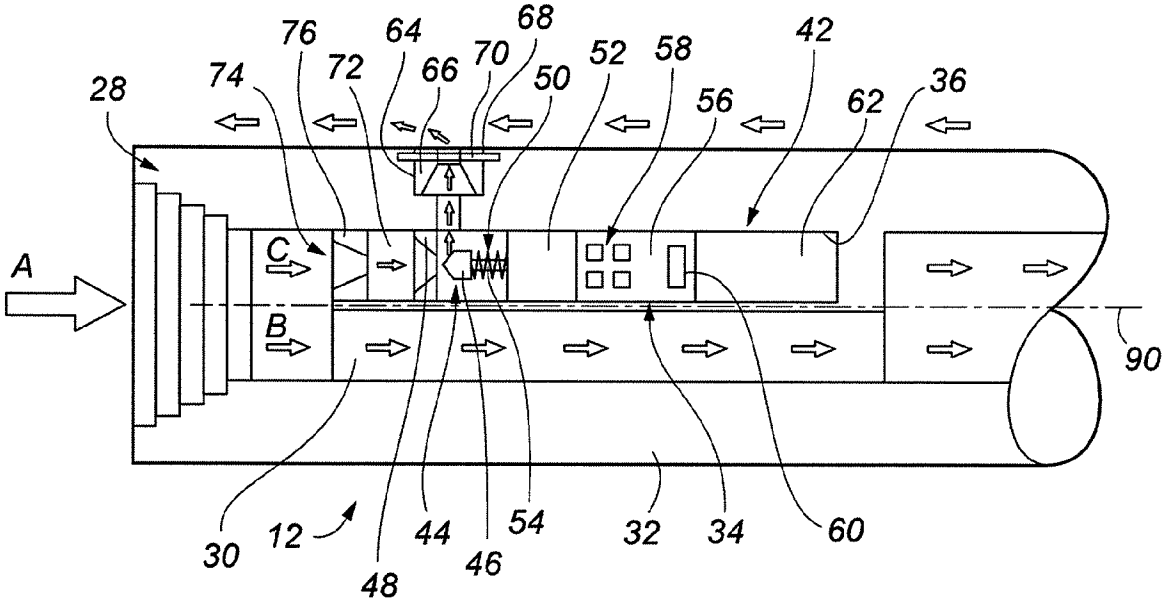
FIG. 2 is a schematic, longitudinal sectional view of an upper end of the apparatus for generating a fluid pressure pulse downhole shown in FIG. 1.
Figure 3:
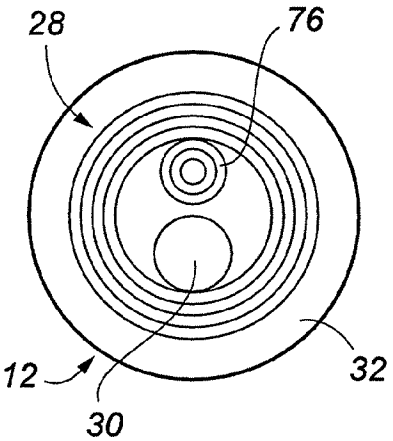
FIG. 3 is an end view of the apparatus for generating a fluid pressure pulse downhole shown in FIG. 1, taken in the direction of the arrow A of FIG. 2.

Referring now also to FIGS. 2 and 3, the MWD tool 12 will be described in more detail. FIG. 2 is a schematic longitudinal sectional view of an upper end 26 of the tool 12, whilst FIG. 3 is an end view taken in the direction of the arrow A of FIG. 2. The MWD tool 12 comprises an elongate, generally tubular housing 28 which defines an internal fluid flow passage 30, and which has a housing wall 32. The MWD tool 12 also comprises a device for selectively generating a fluid pressure pulse, the device indicated generally by reference numeral 34. The device 34 is located at least partly in a space 36 provided in the wall 32 of the tubular housing 28. In the illustrated embodiment, the entire device 34 is located within the space 36.

In use, drilling fluid is directed down through the drill string 10, passing through the connected pipe sections 22 and entering the upper end 26 of the MWD tool 12. The fluid is shown entering the tool 12 at A in FIG. 2. The drilling fluid flows into the internal fluid flow passage 30, as indicated by the arrow B, and on through the tool 12, pipe section 20 and drill collars 18 to the drill bit 16. The fluid is then jetted out of the drill bit 16, and passes back to surface along an annulus 38 defined between an external surface of the drill string 10 and a wall 40 of the wellbore 14. The drilling fluid serves both for cooling the drill bit 16 and for carrying drill cuttings to surface along the annulus 38.

The device 34 of the MWD tool 12 is selectively actuable to generate a fluid pressure pulse in the drilling fluid. These fluid pressure pulses can be measured at surface, and thus utilised to transmit data to surface. As will be described in more detail below, the data may relate to parameters measured downhole using suitable sensors.

Location of the device 34 in the space 36 defined in the housing wall 32 provides advantages over prior apparatus and methods. Specifically, generation of fluid pressure pulses can be achieved without restricting the bore of the fluid flow passage 30. Accordingly, fluid may continue to flow through the MWD tool 12 along the flow passage 30 without restriction due to actuation of the device 34. Additionally, other downhole tools (not shown) may be passed down through the MWD tool 12. Such downhole tools might include a through bit logging tool of a type known in the art and which extends through a port (not shown) in the bit 16. In a similar fashion, downhole tools provided downstream of the MWD tool 12 (not shown) may be actuated through the flow passage 30. For example, many different types of valves and other tools exist which are actuated by a ball or dart that is inserted into the string 10 at surface. The ball would pass down through the drill pipe sections 22 to the MWD tool 12, and on through the tool along the fluid flow passage 30. The ball passes on to the valve where a suitable catcher would receive the ball. A build-up of fluid pressure behind (upstream of) the ball would actuate the valve.

Also, provision of the MWD tool 12 with a housing 28 having a maximum possible wall thickness (relative to the borehole 14 in question) provides advantages in that this facilitates maximisation of a diameter/flow area of the flow passage 30, and of the dimensions of the space 36, without compromising strength. Location of the MWD tool 12 in the region of the string 10 carrying the drill collars 18 may facilitate such maximisation.

The MWD tool 12 and its method of operation will know be described in more detail. The tool 12 is provided in the form of a cartridge, or comprises a cartridge, which can be releasably mounted within the space 36 in the housing wall 32. The tool 12 comprises a main body or cartridge 42 within which the various components of the tool are located. The tool 12 also comprises a main operating valve 44, which includes a valve element 46 which seals against a valve seat 48 provided at an upstream or upper end of the tool 12. The tool 12 is actuable to selectively move the valve element 46 into and out of sealing abutment with the valve seat 48, to generate a fluid pressure pulse. In the illustrated embodiment, a return spring 50 is provided which biases the valve element 46 into sealing abutment with the valve seat 48, and the valve element generally takes the form of a poppet valve.

The tool 12 also comprises an actuator 52 in the form of a solenoid which includes a shaft 54 coupled to the valve element 46. An electronics section 56 contains various sensors, indicated generally by reference numeral 58, and a microprocessor/memory 60 comprising stacked circular printed circuit boards or, alternatively, rectangular printed circuit boards (not shown). The sensors 58 measure certain downhole parameters. Any suitable combination of sensors 58 may be provided and the sensors may comprise orientation, geological and/or physical sensors. The orientation sensor or sensors may be selected from the group comprising an inclinometer; a magnetometer; and a gyroscopic sensor. The geological sensor or sensors may be selected from the group comprising a gamma sensor; a resistivity sensor; and a density sensor. The physical sensor or sensors may be selected from the group comprising sensors for measuring temperature; pressure; acceleration; and strain parameters. The electronics section 56 controls operation of the valve 44 to generate pressure pulses and transmit data to surface. The tool 12 also comprises a power section 62 which provides power for operation of the actuator 52 and electronics section 56. The power section may comprise a conventional battery pack. However, in the illustrated embodiment, the power section 62 comprises a power generating arrangement for generating electrical energy downhole, in accordance with an embodiment of the present invention, and which will be described in more detail below.

The housing 28 includes a radial flow port 64 extending through the housing wall 32. A flow restrictor in the form of a nozzle, typically a bit jet 66, is located adjacent an outlet 68 of the flow port 64 and is secured in place using a retainer 70. The tool 12 also defines a secondary fluid flow passage 72 which extends between an interior of the housing 28 and an exterior of the housing, in this case the annulus 38. The outlet 68 of the flow port 64 opens onto the annulus 38, and an inlet 74 opens on to the interior of the housing. A flow restriction in the form of a nozzle, again typically a bit jet 76, is provided adjacent the inlet 74. In use, the main valve 44 controls flow of fluid along the secondary fluid flow passage 72 to generate a fluid pressure pulse. The device 34 may comprise a sleeve, plug or the like (not shown) for closing the secondary fluid flow passage 72, and the sleeve may be actuable to close the inlet 74.

With the valve 44 in a closed position in which the valve element 46 is in sealing abutment with the valve seat 48, fluid flow along the secondary fluid flow passage 72 is prevented. Accordingly, all fluid entering the tool 12 in the direction of the arrow A passes into the primary fluid flow passage 30. To generate a fluid pressure pulse, a signal is sent by the processor/memory 60 to the actuator 52, to translate the solenoid shaft 54 and move the valve element 46 out of sealing abutment with the valve seat 48. This opens the secondary fluid flow passage 72, and fluid entering the tool 12 can now enter the inlet 74, as shown by the arrow C in FIG. 2. The fluid flows on through the valve seat 48 and enters the flow port 64, from where it is jetted into the annulus 38 through the bit jet 66. Opening the secondary fluid flow passage 72 therefore effectively increases the flow area of the tool 12. Consequently, the pressure of the drilling fluid upstream of the inlet 74 reduces so that a negative pressure pulse is generated which can be detected at surface. After a desired period of time, the actuator 52 is deactivated and the return spring 50 urges the valve element 46 back into sealing abutment with the valve seat 48. This once again closes the secondary fluid flow passage 72, reducing the flow area of the tool 12 and raising the pressure of the drilling fluid upstream of the inlet 74. The valve 44 is operated a number of times to move between closed and open positions to thereby generate a string of pressure pulses which are detected at surface. In a known fashion, data relating to downhole parameters measured by the sensors 58 can be transmitted to surface by means of these fluid pressure pulses.

If desired, positive fluid pressure pulses may be generated. This is achieved by normally holding the valve element 46 out of sealing abutment with the valve seat 48 (or by holding the valve element out of abutment for a certain period of time), such that the secondary fluid flow passage 72 is open. This is achieved by providing a tension spring in place of the compression spring 50, which urges the valve element 46 away from the valve seat 48. Operation of the actuator 52 then acts against the force of the spring to urge the valve element 46 into sealing abutment with the valve seat 48. Repeatedly closing the valve 44 thus closes the secondary fluid flow passage 72 to generate positive pressure pulses. It will be appreciated that in an alternative, the actuator 52 may be maintained in an activated state to hold the valve element 46 clear of the valve seat 48. However, this will utilise additional electrical energy and is generally undesired.

To facilitate operation of the valve 44, the device 34 comprises a pressure balancing system (not shown in FIG. 2 or 3) which includes a floating piston. The floating piston is coupled to the valve element 46, and a face of the piston is exposed to fluid at the prevailing wellbore pressure. In this fashion, the large fluid pressure force which would be exerted upon the valve element 46 due to the prevailing wellbore pressure can be balanced using the floating piston. Accordingly, the force required to operate the valve 44 and move the valve element 46 off the valve seat 48 is much lower than would be the case if a downstream face of the valve element 46 were exposed to fluid only at atmospheric pressure.

Figure 4:
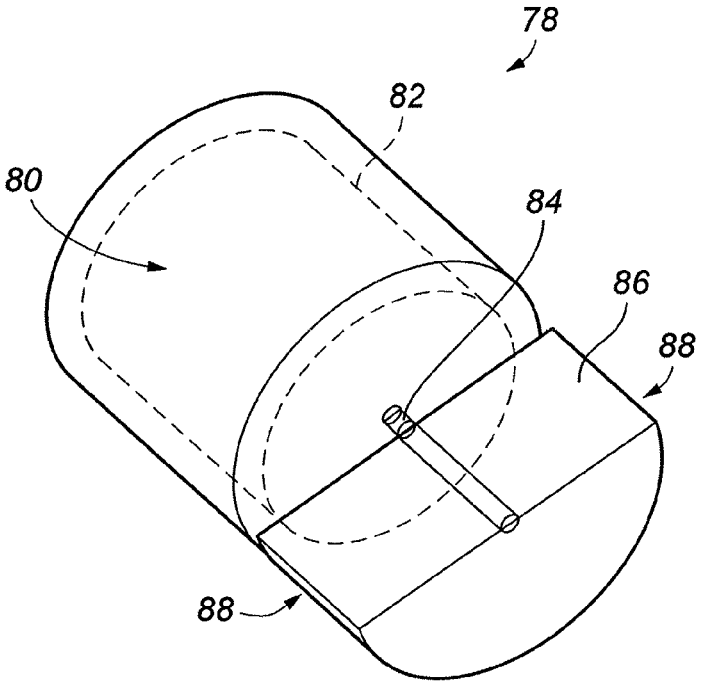
FIG. 4 is a schematic perspective view of a power generating arrangement for generating electrical energy downhole, in accordance with an embodiment of the present invention, and which may form part of the apparatus for generating a fluid pressure pulse shown in FIGS. 1 to 3.

Turning now to FIG. 4, there is shown part of a power generating arrangement or energy harvesting arrangement for generating electrical energy downhole, and which forms part of the power section 62. The power generating arrangement is indicated generally by reference numeral 78, and comprises a generator 80. The generator 80 is a conventional type DC generator comprising a stator 82 (indicated in broken outline) and a rotor, part of which is shown and given the reference numeral 84. Typically, the stator 82 will carry permanent magnets (not shown) and the rotor 84 copper windings (also not shown), although the windings may instead be provided on the stator and the magnets on the rotor. The generating arrangement 78 is arranged to convert kinetic energy into electrical energy for providing power to operate the electrical components of the device 34. In particular, the generating arrangement 78 provides power for operation of the actuator 52, sensors 58 and processor/memory 60. The generating arrangement 78 also comprises a body 86 coupled to the rotor 84. The body 86 is an eccentric mass and is generally elliptical in shape defining two lobes 88. In this fashion, rotation of the drill string 10, and thus of the housing 28 of the MWD tool 12, causes the body 86 to rotate relative to the stator 82. This drives and rotates the rotor 84 relative to the stator 82 to generate electrical energy.

The space 36 defined by the housing 28 is provided off-centre from a main axis 90 of the housing 28 (FIG. 2), and is in side-by-side relation to the fluid flow passage 30 (which is itself off-centre i.e. non-coaxial to the housing main axis 90). This off-centre or eccentric location of the space 36 further enhances rotation of the body 86 when the drill string 10 is driven and rotated, thereby enhancing power generation. In particular, the stick-slip motion which occurs when the drill bit 16 sticks or jams (which is frequently the case), and the resultant whiplash effect, further enhances power generation. Positioning the MWD tool 12 above the bit 16 may facilitate maximisation of the whiplash effect experienced by the body 86 and thus power generation.

Whilst the power generating arrangement 78 has been shown and described particularly in relation to the MWD tool 12 of the present invention, it will be understood that the power generating arrangement has a utility with a wide range of different types of downhole tools. Indeed, the power generating arrangement 78 has a utility with any downhole tool in which electrical energy may be utilised to control operation of the whole or a part of the tool, or indeed to provide power for sensory, control and/or memory storage functions. For example, the power generating arrangement 78 may be utilised to operate a valve of a circulation valve assembly (not shown) provided in a string of tubing which is rotated from surface. In the event that the MWD tool 12 is utilised with a downhole mud motor, as described above, it will be understood that the MWD tool 12 would be mounted below (downstream) of the motor such that the housing 28 would be rotated together with the drill bit 16.

Figure 5:
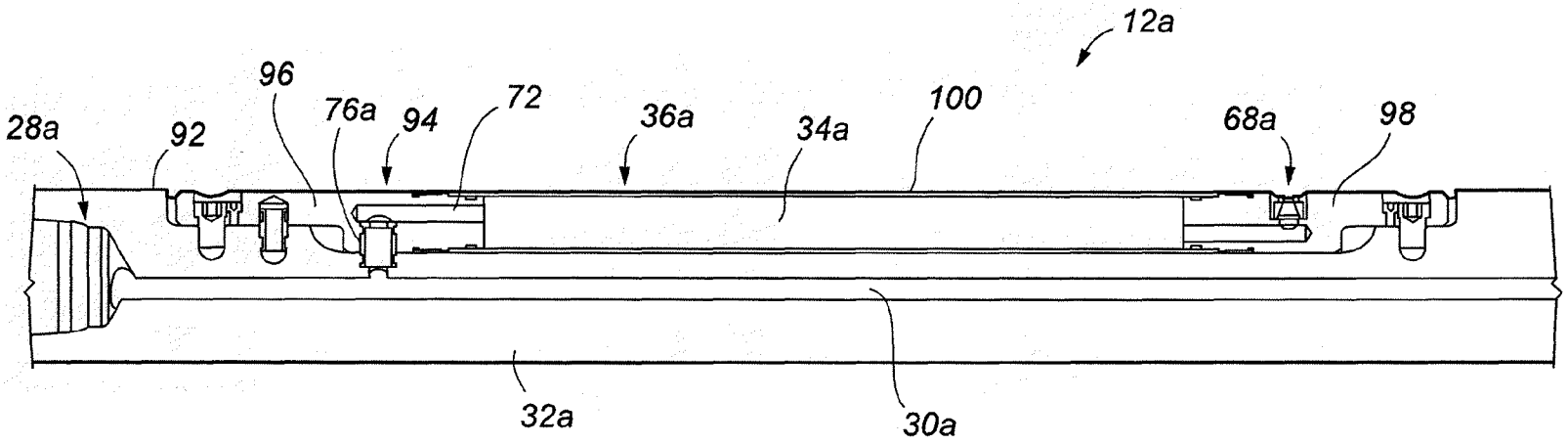
FIG. 5 is a longitudinal cross-sectional view of part of an apparatus for generating a fluid pressure pulse downhole, in accordance with an alternative embodiment of the present invention

Turning now to FIG. 5, there is shown part of an apparatus for generating a fluid pressure pulse downhole in accordance with an alternative embodiment of the present invention, the apparatus indicated generally by reference numeral 12*a*. The apparatus 12*a* takes the form of an MWD tool, and like components of the tool 12*a* with the tool 12 of FIGS. 1 to 4 share the same reference numerals, with the addition of the suffix 'a'. The tool 12*a* is in fact of similar construction and operation to the tool 12 and can be mounted in the drill string 10 shown in FIG. 1 in the place of the tool 12. Accordingly, only the substantial differences between the tool 12*a* and the tool 12 will be described in detail herein.

In the illustrated embodiment, the tool 12*a* comprises a generally tubular housing 28*a* having a housing wall 32*a*. The housing 28*a* defines an internal fluid flow passage 30*a*. A space 36*a* is provided in the wall 32*a* and, in this instance, the space 36*a* takes the form of an axially extending channel or recess formed in an external surface 82 of the housing 28*a*. A device 34*a* for generating a fluid pressure pulse is mounted in the space 36*a* by means of a mounting arrangement 94. The mounting arrangement 94 comprises upper and lower mounting bodies 96 and 98, and a main housing part 100 which is coupled and sealed relative to the upper and lower mounting bodies 96 and 98. The device 34*a* is mounted within the main housing part 100. This permits pressure and operational testing of the assembled device 34*a* and mounting arrangement 94 prior to location in the space 36*a*. An inlet 76*a* in the form of a radial flow port opens onto the primary fluid flow passage 30*a* and an outlet 68*a* opens to annulus 38. Flow of fluid from the primary fluid flow passage 30*a* through inlet 76*a* to outlet 68*a* and annulus is controlled by a valve (not shown) in the device 34*a*, in a similar fashion to the valve 44 in the device 34 of FIG. 2.

Mounting of the device 34*a* in the recess 36*a* offers advantages in that the device 34*a* can readily be located in the recess 36*a*, and released for maintenance and/or replacement. Additionally, where the device 34*a* includes a power generating arrangement similar to the arrangement 78 shown in FIG. 4, the further off-centre location of the device is such that the power generation effect would be enhanced. Furthermore, certain types of sensor which may be incorporated into the device 34*a* benefit from location in the recess 36*a* at the external surface 92 of the tool 12*a*. In particular, the sensitivity of gamma sensors (not shown) would be enhanced as the gamma rays would not require to pass through a significant portion of metal in order to interrogate a rock formation.

Whilst the apparatus of the present invention has been shown and described in FIGS. 1 to 5 primarily as a MWD tool, it will be appreciated that the principles of the invention may be applied in other downhole apparatus and/or methods. For example, either of the apparatus 12 or 12*a* may be incorporated into a completion tubing string, such as production tubing (not shown). In this situation, the sensors would be tailored appropriately having in mind that the drilling phase would then have been completed. The sensors incorporated into the apparatus would typically be for measuring compressive and/or torsional or other loads in the production tubing string carrying the apparatus.

Additionally, it will be understood that a downhole assembly in the form of a drill string or completion tubing string, or indeed any other suitable tubing string, may be provided with two or more of the apparatus 12 or 12*a*. Where two or more of the apparatus 12 or 12*a* are provided, they may be spaced along a length of the tubing string. This may facilitate transmission of data from sensor measurements taken at different areas along a length of the wellbore 14.

Figure 6:
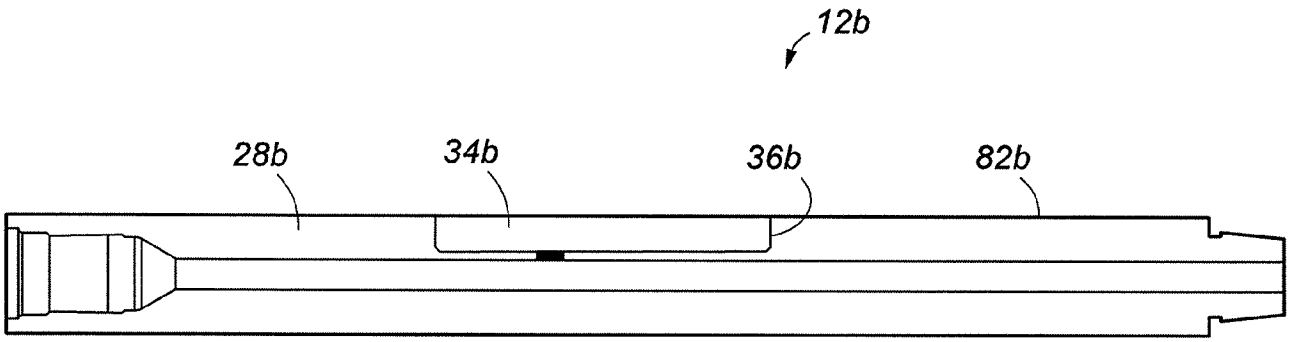
FIGS. 6 to 8 are schematic longitudinal cross-sectional, enlarged perspective and enlarged detailed views, respectively, of an apparatus for generating a fluid pressure pulse downhole in accordance with another embodiment of the present invention.
Figure 7:
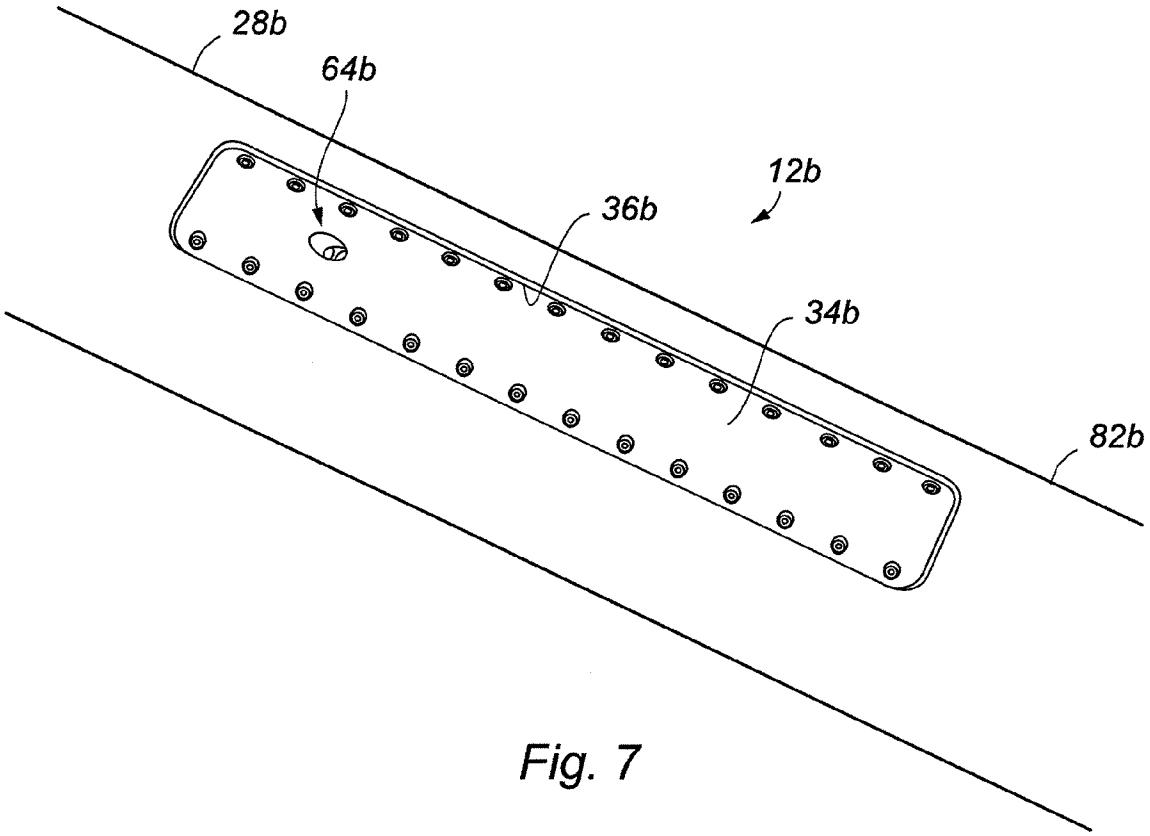
Figure 8:
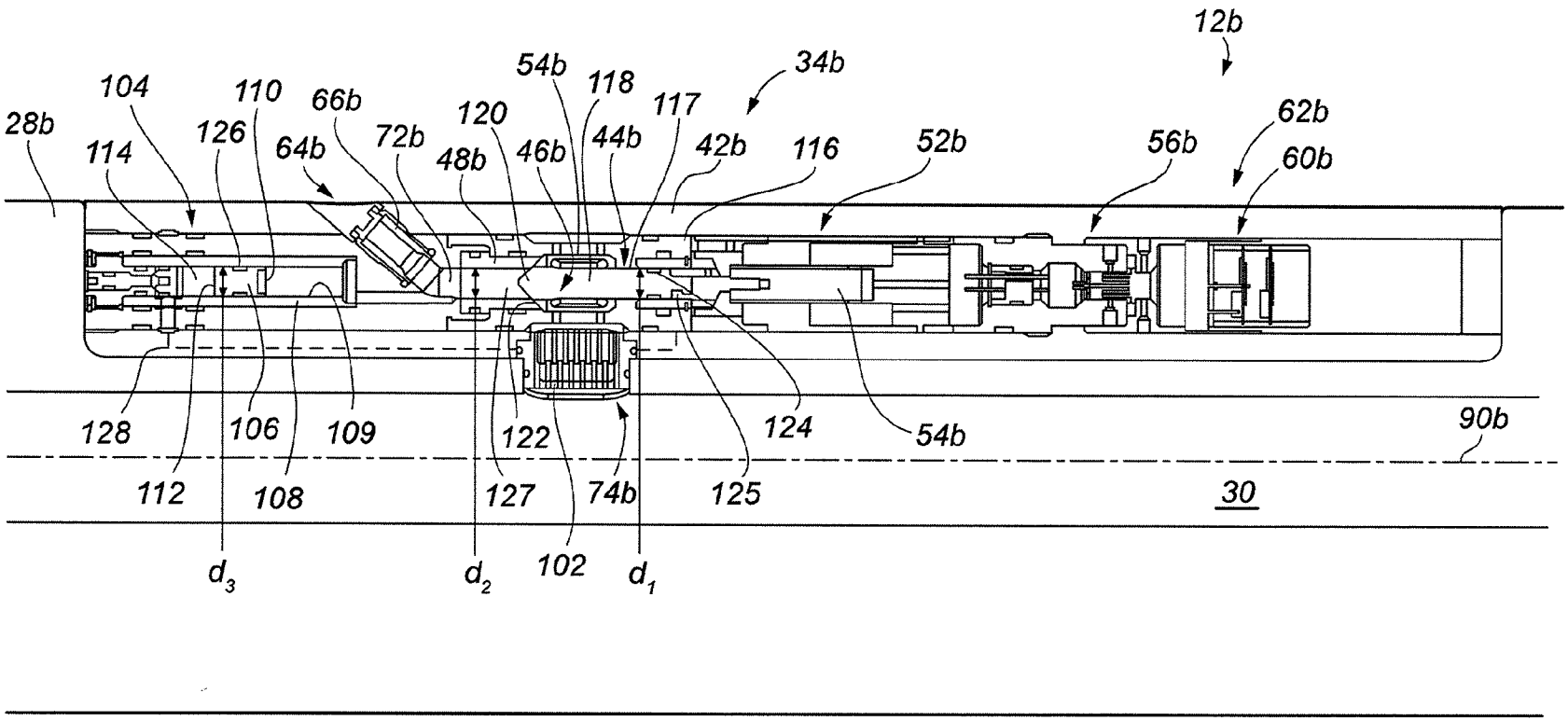

Turning now to FIGS. 6 to 8, there are shown schematic longitudinal cross-sectional, enlarged perspective and enlarged detailed views of an apparatus for generating a fluid pressure pulse downhole in accordance with another embodiment of the present invention, the apparatus indicated generally by reference numeral 12*b*. The apparatus 12*b* similarly takes the form of an MWD tool, and like components of the device 12*b* with the device 12 of FIGS. 1 to 4 share the same reference numerals, with the addition of the suffix 'b'. FIGS. 6 and 8 are views of the apparatus 12*b* sectioned along a plane which passes through a main axis 90*b* of a housing 28*b* of the apparatus.

The tool 12*b* comprises a device 34*b* for generating a pulse, which is located in a space 36*b* in a housing 28*b* of the tool. The space 36*b* takes the form of an axially extending channel or recess formed in an external surface 82*b* of the housing 28*b*. In this respect, the tool 12*b* is similar to the tool 12*a* shown in FIG. 5. The tool 12*b* includes all of the major components of the tool 12 shown in FIGS. 1 to 4, and thus comprises a main body or cartridge 42*b* housing the various tool components, which include a main operating valve 44*b* having a valve element 46*b* which seals against a valve seat 48*b* to generate a fluid pressure pulse. Fluid flows through a secondary fluid flow passage 72*b* by means of an inlet 74*b*, which communicates with an internal fluid flow passage 30 that is coaxial with a main axis 90*b* of the tool. An actuator 52*b* has a solenoid including a shaft 54*b* which is coupled to the valve element 46*b*. An electronics section 56*b* contains various sensors (not shown) and a microprocessor 60 and power section 62 is also provided. A flow port 64*b* extends at an angle to the main axis 90*b*, and a jet 66*b* can be tuned to provide a desired flow restriction, according to particular requirements. The general operating principles of the tool 12*b* are the same as for the tool 12 described above. The main differences between the tools 12*b* and 12 are as follows.

The tool 12*b* comprises a filter 102 in the inlet 74*b* which is of a kind known in the art, and which filters particulates (solids) of a certain size to prevent the particulates from entering the device 34*b*. FIG. 8 illustrates a pressure balancing system 104 of the device 34*b*. The system 104 includes a floating piston 106, which is mounted in a cylinder 108 having an internal bore 109. The piston 106 has first and second or front and rear piston faces 110 and 112. The first piston face 110 is exposed to the pressure of fluid in the secondary fluid flow passage 72*b*, and thus is typically exposed to drilling mud or other downhole fluids. The second piston face 112 opens on to a chamber 114 which is filled with a clean hydraulic fluid. The chamber 114 communicates with a cylinder in the form of a sleeve 116 having an internal bore 117 via a communication line 128, shown schematically in FIG. 8. A shaft 118 of the valve 46*b* is mounted in the bore 117, and the solenoid 54*b* is coupled to the shaft, for actuating the valve.

The valve element 46*b* and sleeve 116, valve seat 48*b*, floating piston 106 and cylinder 108 are constructed so as to balance the forces acting on the valve element 46*b* during use.

This is achieved as follows. The valve element 46*b* has a tapered head 120 defining a sealing surface which seals against a valve seat surface 122 of the valve seat 48*b*. The valve shaft 118 carries a seal 124 which seals the shaft within the sleeve 116, and the valve element has a rear face 125. The floating piston 106 similarly carries a seal 126, which seals the piston within the cylinder 108. The sleeve 116 is dimensioned such that the internal bore 117 of the sleeve is of a diameter $d_1$ which is the same as a minimum diameter $d_2$ provided through the valve seat 48*b* (which is the diameter of the bore 127), and which is the same as a diameter $d_3$ of the internal bore 109 of the cylinder 108 in which the floating piston 106 is mounted. In this way, piston areas of the internal bore 127 of the valve seat 48*b*, the internal bore 109 of the floating piston cylinder 108, and the internal bore 117 of the valve sleeve 116 are the same.

Figure 8A:
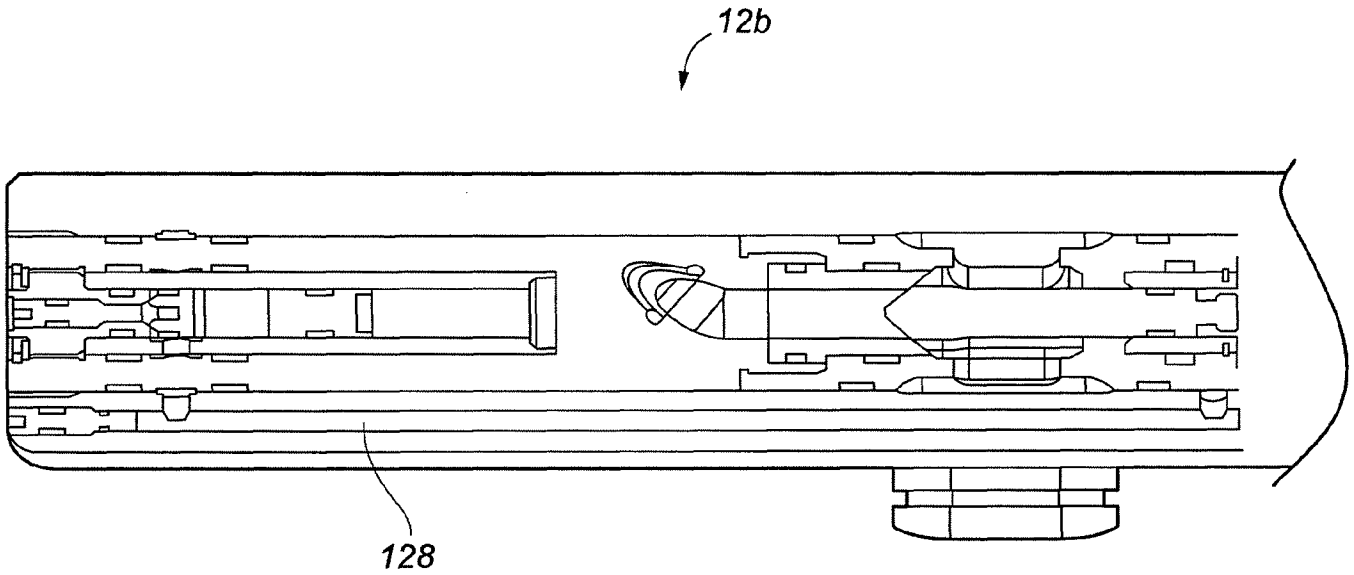
FIG. 8A is an enlarged view of part of the apparatus shown in FIG. 8, sectioned along a different plane.

As a consequence, a fluid pressure force acting upon the head 120 of the valve element 46*b* (when the valve is closed) and the first face 110 of the floating piston 106 is the same. This force is transmitted to the valve shaft 118 via the second face 112 of the floating piston 106, which acts on the hydraulic fluid in the chamber 114. The chamber 114 communicates with the valve cylinder 116 by the communication line 128. The communication line is better shown in FIG. 8A, which is an enlarged view of part of the apparatus 12*b* sectioned along a different plane to that of FIG. 8, which plane does not pass through the housing main axis 90*b*. As the diameter $d_3$ of the bore 109 of the floating piston cylinder 108 is the same as the diameter $d_1$ of the bore 117 of the valve sleeve 116 and the diameter $d_2$ of the valve seat bore 127, the fluid pressure force acting on the rear face 125 of the valve is the same as that acting on the first face 110 of the floating piston and on a sealing face of the valve which abuts the valve seat surface 122. When the valve is closed, this is the wellbore pressure, communication occurring through the port 64*b*. This serves for balancing the fluid pressure forces acting on the tapered head 120 of the valve element 46*b*, and the shaft 118. The result of this is that the net fluid pressure force on the valve element 46*b* is negligible or even zero. Consequently, a spring 54*b* acting on the valve element 46*b* does not need to account for fluid pressure forces acting on the valve element to hold the valve closed, as is the case with prior valves.

When the valve is opened, the sealing face defined by the head 122 of the valve element and the first face 110 of the floating piston are exposed to the pressure of fluid in the main bore 30 of the tool. When it is desired to close the valve, the solenoid is deactivated and the spring 54*b* returns the valve element 46*b* into sealing abutment with the valve seat 48*b*. The valve element 46*b* is arranged to move sufficiently clear of the valve seat 48*b* so as to mitigate suction forces which have been known to occur in prior valves of other tools, and which tend to act to urge the prior valve elements back into abutment with their valve seats. Such additional forces require energy input to maintain the valves open. These forces occur due to flow through the annular space which is created when the valves are opened, which occur due to there being a substantial pressure drop across the prior valve elements, as the clearance is relatively small. Typically, the valve element 46*b* of the invention will move at least around 4 mm to 5 mm when actuated to open, in contrast to prior valves which only move around 2 or 3 mm at most, this mitigating the suction forces.

Figure 8B:
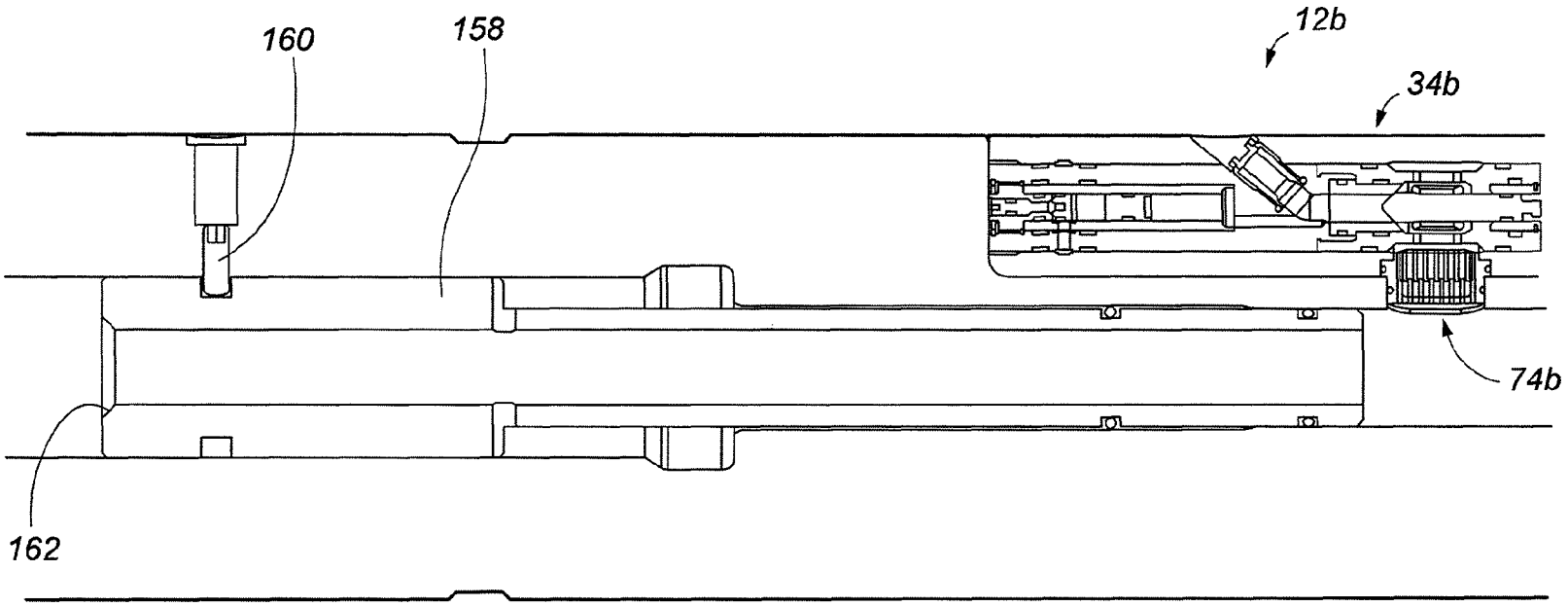
FIGS. 8B and 8C are further enlarged views of part of the apparatus shown in FIG. 8 and incorporating a sealing member in the form of a sleeve, for closing an inlet port of the apparatus, FIG. 8B showing the sleeve in an open position and FIG. 8C in a closed position.
Figure 8C:
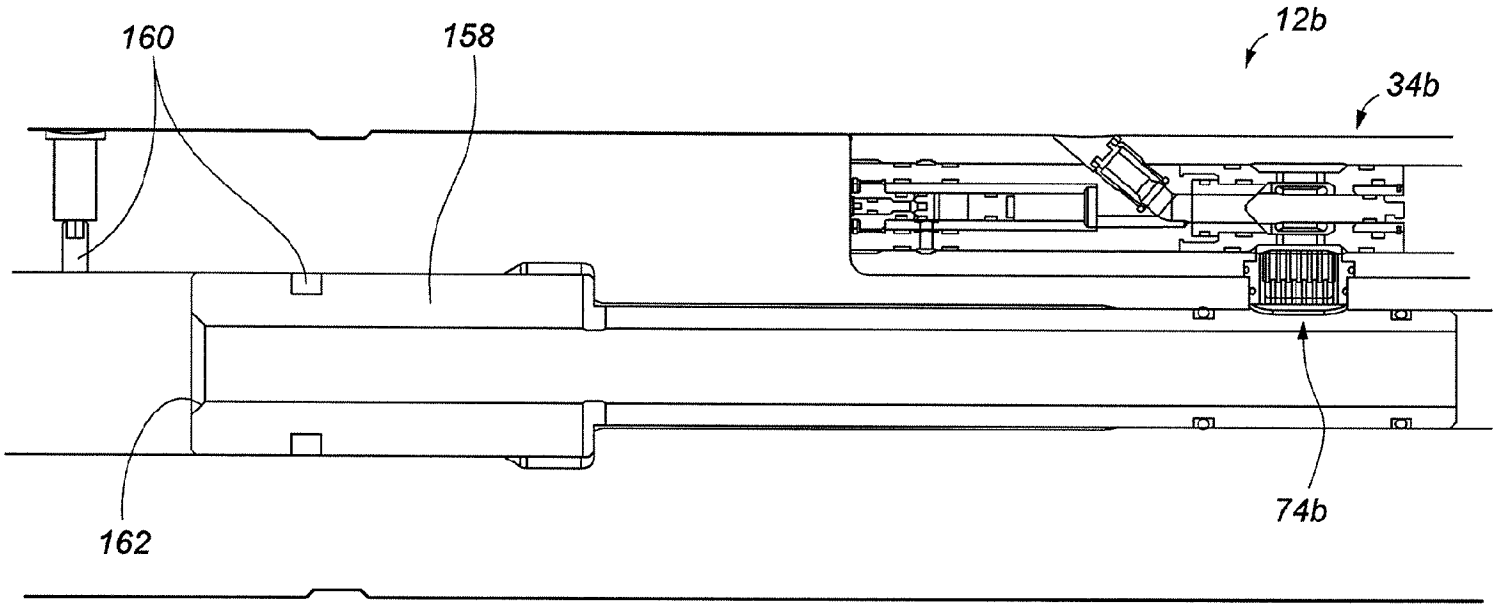

Turning now to FIGS. 8B and 8C, there are shown further enlarged views of a part of the apparatus 12*b*, and which illustrate an optional sealing element in the form of a sleeve 158, which serves for selectively closing the inlet 74*b*. The sleeve 158 can be actuated to move between an open position (FIG. 8B) and a closed position (FIG. 8C) to close the inlet port 74*b*, and thus shut off communication between the device 34*b* and the primary fluid flow passage 30*b*. The sleeve 158 is actuable in a number of different ways. Typically however, the sleeve 158 is actuated to close by a shifting tool (not shown) which is run into the main bore 30*b* from surface. The shifting tool engages the sleeve 158 and shifts it down to close the inlet 74*b*. A shear pin 160 restrains the sleeve 158 against movement until such time as sufficient force is applied to shear the pin so that the sleeve can move. Alternatively, the sleeve 158 may be actuated by dropping a ball, dart or the like (not shown) into the string of tubing carrying the apparatus 12*b* at surface. The ball lands on a seat 162 of the sleeve, and pressuring up behind (upstream of) the ball shears the pin 160 and moves the sleeve down. The ball may be deformable so that it can subsequently be blown through the seat 162 to reopen the bore 30*b*, by further raising the pressure behind the ball. In a further variation, the sleeve may be internally actuable, controlled by the apparatus 12*b*. For example, the apparatus 12*b* may be actuable by a hydraulic signal from surface to cause the sealing element to move between open and closed and/or closed and open positions. Such may be achieved by application of fluid pressure to a piston face of the sleeve 158. In variations, a sealing element in the form of a ball, dart or the like (not shown) may be inserted into the bore 30*b* to close the inlet port 74*b*. This might be achieved by providing a seat in the region of the inlet port 74*b*. The ball, dart or the like may again be deformable for reopening the bore 30*b*.

The apparatus 12, 12*a* and 12*b* described above and shown in FIGS. 1 to 8 each have a particular utility as an MWD tool. However, each apparatus 12, 12*a* and 12*b* may have a utility in a wide range of different types of downhole tools, or indeed in a wide range of different types of tubing strings, as will now be described with reference to FIGS. 9 to 16. Each of the following embodiments may utilise any of the tools 12, 12*a* and 12*b*. However, the illustrated embodiments typically employ an apparatus which is similar to the apparatus 12*b* shown in FIGS. 6 to 8. Like components of the apparatus employed in the various tools/tubing shown in FIGS. 9 to 16 with the apparatus 12 shown in FIGS. 1 to 4 share the same reference numeral, with the addition of the suffix 'c', 'd', etc.

Figure 9:
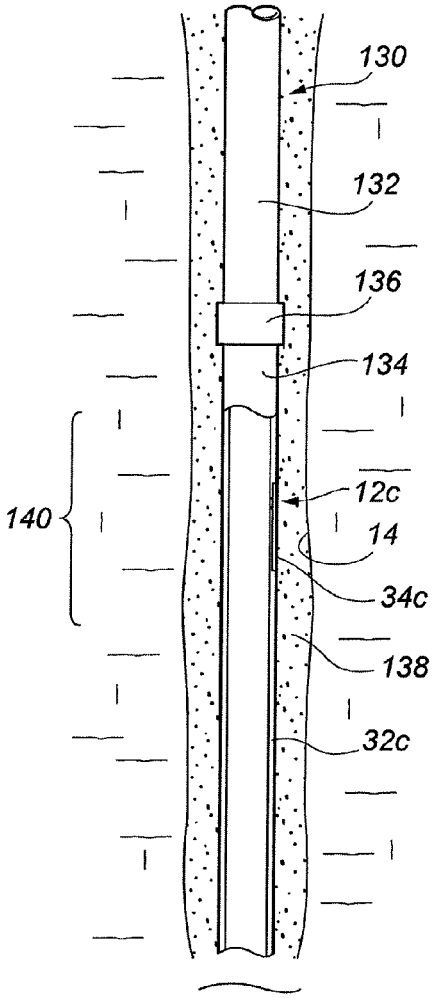
FIGS. 9 to 16 are schematic views of various different types of tubing incorporating apparatus for generating a fluid pressure pulse downhole, in accordance with embodiments of the present invention.

Turning therefore to FIG. 9, there is shown a wellbore lining tubing in the form of a casing 130, which comprises a series of tubing sections coupled together end-to-end, two of which are shown and given the reference numerals 132 and 134. The casing sections are coupled together using casing collars, one of which is shown and given the reference numeral 136. The casing 130 is located in a drilled wellbore, which in the illustrated embodiment is the wellbore 16 of FIG. 1, and is cemented in place at 138, in a fashion known in the art.

The casing section 134 carries apparatus 12*c* for generating a fluid pressure pulse, a device 34*c* of the tool disposed in a wall 32*c* of the casing section, which forms the housing for the device 34*c*. The apparatus 12*c* serves for measuring one or more downhole parameters in the general location of a region 140 of the wellbore 14, and for selectively transmitting data corresponding to the measured parameter or parameters to surface, in the fashion described above. Such parameters might include downhole temperature, downhole pressure, azimuth of the casing 130, data indicating a position of the apparatus 12 relative to a high side of a deviated well (not shown) and/or data relating to strain in the casing 130. It will be understood that the apparatus 12*c* may also serve for measuring downhole parameters during running of the casing to the desired depth, and may store and subsequently transmit data corresponding to such parameters when the apparatus is activated.

Figure 10:
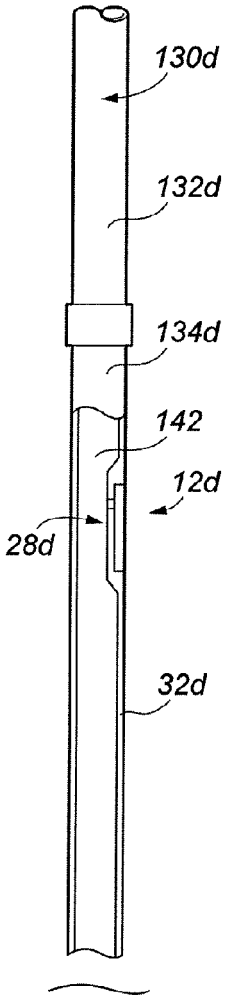

FIG. 10 shows a variation on FIG. 9 in which a casing 130*d* comprises casing sections 132*d* and 134*d*, the section 134*d* carrying apparatus 12*d* for generating a fluid pressure pulse and which is of like construction to the apparatus 12*b*. In this instance, a wall 32*d* of the casing section 134*d* is shaped to include a portion 28*d* which protrudes into a main bore 142 of the casing section. The portion of the housing 28*d* which protrudes into the main bore 142, and indeed components of the apparatus 12*d*, may be drillable. In this fashion and following location and cementing of the casing 130*d* downhole, and the transmission of desired data to surface, the housing 28*d* and apparatus 12*d* may be drilled to reopen full bore access through the casing section 134*d*.

Figure 11:
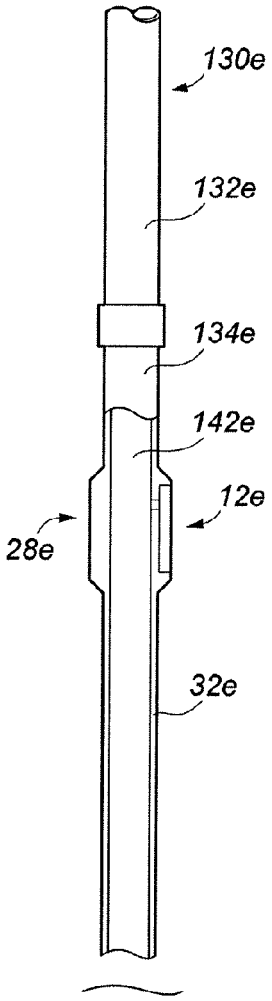

Turning to FIG. 11, there is shown a casing 130*e* comprising connected sections 132*e* and 134*e*, the section 134*e* carrying apparatus 12*e* for generating a fluid pressure pulse which is of similar construction to the apparatus 12*b*. In this instance, the wall 32*e* of the casing 134*e* is shaped to define a housing in the form of a upset 28*e* which contains the apparatus 12*e*. In this fashion, a main bore 142*e* of the casing remains unrestricted.

Whilst each of the embodiments of FIGS. 9 to 11 have been described in relation to wellbore lining tubing in the form of a casing, it will be understood that the principles apply equally to other types of wellbore-lining tubing, including tubing in the form of a liner (not shown).

Figure 12:
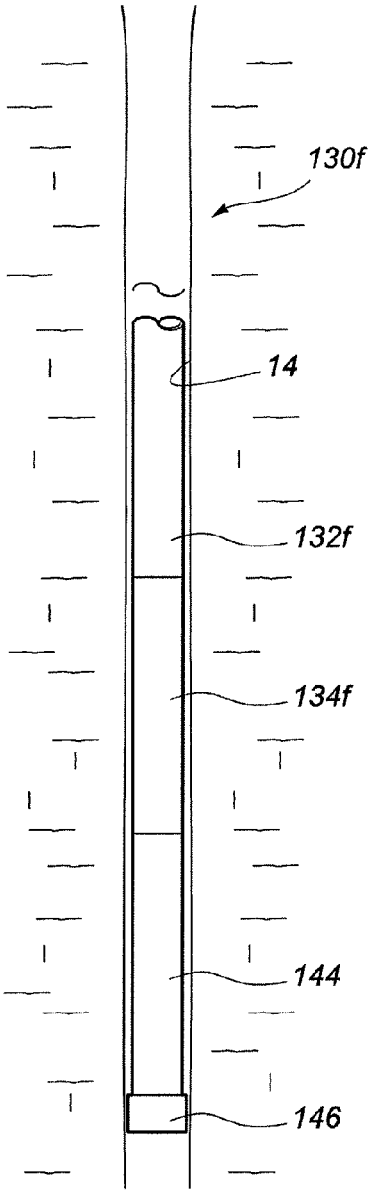

Turning now to FIG. 12, there is shown a casing 130*f* during running-in to the wellbore 14. In this instance, the casing 130*f* includes a casing shoe in the form of a casing reamer shoe 144, which carries a reamer 146. The casing 130*f* is rotated from surface during run-in to the wellbore 14, the reamer 146 serving to smooth the internal wall of the drilled wellbore 14, in a fashion known in the art. The casing reamer shoe 144, or casing sections 132*f* or 134*f* connected in series to the shoe, carry apparatus for generating a fluid pressure pulse (not shown), which may typically take the form of the apparatus 12*b*. In a variation on the embodiment of FIG. 12, the casing 130*f* may include a downhole motor located above the casing reamer shoe 144, which serves for driving and rotating the casing reamer shoe and any casing sections located between the motor and the reamer shoe. In this fashion, it is not necessary to rotate the entire casing string. Such may be of a particular utility in a deviated wellbore. The apparatus for generating a fluid pressure pulse provided in the casing 130*f* (and indeed the described variation) may serve for transmitting data relating to a number of downhole parameters to surface. These might include downhole pressure, temperature and/or strain measurements in the casing, for example. Again, the principles described above in relation to FIG. 12 may be applied to other wellbore-lining tubing, such as tubing in the form of a liner.

Figure 13:
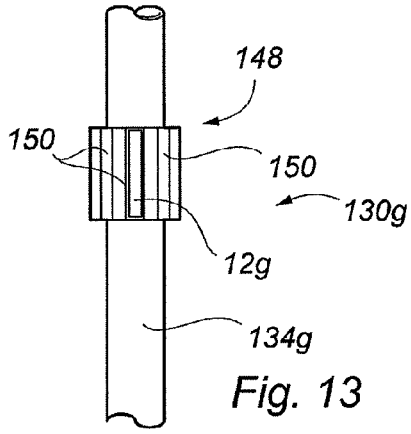
Figure 14:
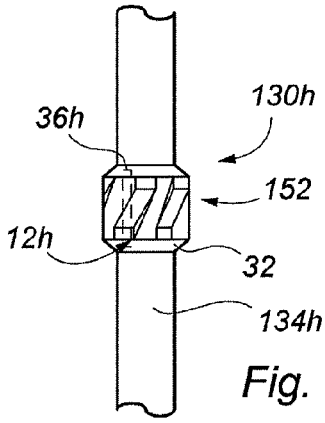
Figure 15:
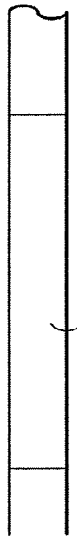

Turning now to FIGS. 13, 14 and 15, there are shown casings 130*g*, 130*h* and a downhole tubing string 130*i*.

The casing 130*g* comprises a casing section 134*g* which includes a centraliser 148, of a type known in the art, and which has a series of axially extending flutes 150. The centraliser 148 serves for centralising the casing 130*g* within a wellbore and the flutes 150 permit fluid passage up an annulus between an external surface of the casing and an internal surface of the wellbore wall. In this instance, an apparatus 12*g* for generating a fluid pressure pulse is located in one of the flutes 150. The apparatus 12*g* is typically similar to the apparatus 12*b* described above.

The casing 130*h* includes a casing section 134*h* which carries a drift tool 152, of a type known in the art. The drift tool serves for verifying a diameter of a bore in which the casing 130*h* is located. An apparatus for generating a fluid pressure pulse 12*h* is provided in a space 36*h* in a wall 32 of the drift tool 152. Again, the apparatus 12*h* is typically similar to the apparatus 12*b*.

It will be understood that the principles of the casings 130*g* and 130*h* may be applied to other wellbore-lining tubing, such as a liner, or indeed to other downhole tubing. Such might include completion tubing in the form of production tubing, or a tool string for running a downhole tool into a wellbore for performing a particular function. In such cases, the centraliser 148 may serve for centralising the tubing in question within another, larger diameter tubing.

FIG. 15 schematically illustrates a tool string 130*i* which may be used for running any one of a wide range of different types of downhole tools into a well. Such might, for example, include a valve, a circulation tool, a perforation tool or other suitable tools. A section 134*i* of the tool string 130*i* carries an apparatus for generating a fluid pressure pulse, which typically takes the form of the apparatus 12*b* described above.

Figure 16:
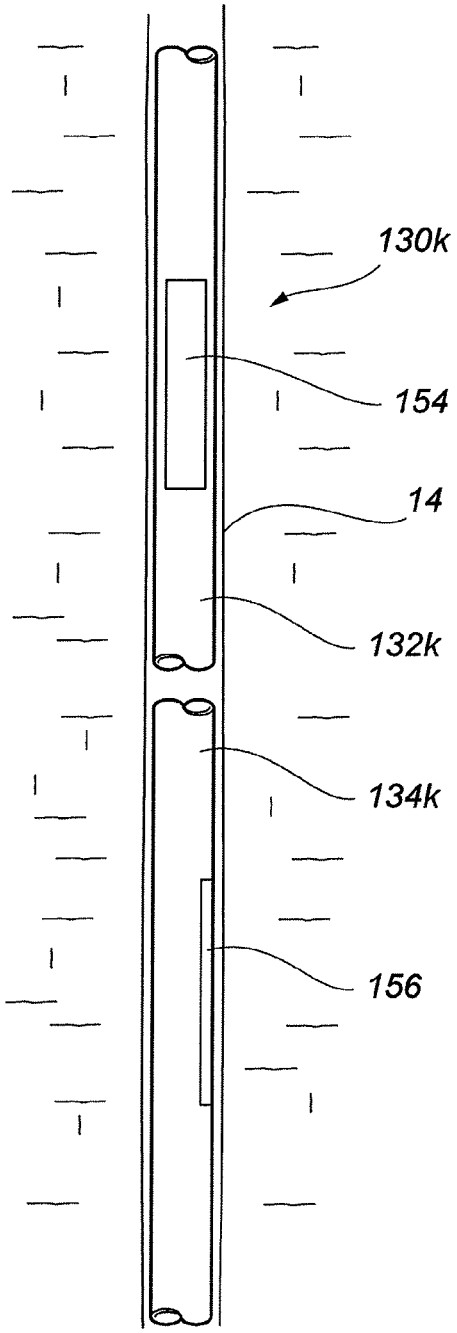

Turning now to FIG. 16, there is shown a casing 130*k* during running into a wellbore, which is the wellbore 14 shown in FIG. 1. As with previously described casings, the casing 130*k* comprises a series of casing sections coupled together end-to-end. Casing sections 132*k* and 134*k* are shown in the Figure, each of which comprises a pre-milled window 154, 156 respectively. The casing 130*k* forms part of a multilateral system, where a number of lateral wells are drilled, extending from the main wellbore 14. In the illustrated embodiment, two such laterals are to be drilled, extending through the pre-milled windows 154 and 156 in the casing sections 132*k* and 134*k*. It will be understood that the lateral wellbores may be spaced some hundreds or thousands of meters apart along a length of the wellbore 14. Additionally, it may be desired to extend each lateral in a different direction from the main wellbore 14, as is indicated by the different orientations of the windows 154, 156 in the drawing.

As will be understood by persons skilled in the art, the casing 130*k* is made-up by connecting the casing sections together and torquing-up casing connections (not shown—which may take the form of collars) located between the casing sections. Additionally, the casing 130*a* may have to be rotated during running-in. This can lead to torque building-up in the casing 130*k*, which might lead to the position of the windows 154, 156 changing during running and location within the wellbore 14. As a result, there is a desire to be able to verify the position of the windows 154 and 156 prior to running equipment necessary to drill the lateral wellbores. The usefulness of having multiple apparatus for generating pressure pulses (which may also be referred to as monitoring assemblies) is therefore also likely to be associated with providing data for planning the new borehole trajectory, based on the information measured, with consequent time savings. Accordingly, each of the casing sections 132*k* and 134*k* carry apparatus for generating a fluid pressure pulse in accordance with the present invention, typically in the form of the apparatus 12*b*. The apparatus may be part of either the casing sections or of the connections or couplings.

Following positioning within the wellbore 14, parameters which might include azimuth; parameters indicative of positions of the windows 154 and 156 relative to a high side of a wellbore (where the wellbore is deviated); and/or strain in the casing sections 132*k* and 134*k* can be measured. The pressure pulsing apparatus in each casing section 132*k*, 134*k* can then be activated to transmit data concerning the measured parameter or parameters to surface. This may enable an operator to determine whether the windows 154, 156 are correctly oriented. If not, then remedial action may be necessary including rotating the casing 130*k* to release any built-up torque. The parameter or parameters can then be re-measured and the data transmitted to surface to re-verify position, and this repeated as or if necessary until the windows 154, 156 are in their correct positions.

The pulsing apparatus carried by the casing sections 132*k* and 134*k* may be arranged to be actuated separately or via a single activation signal. Separate activation may be achieved, for example, by applying a particular triggering signal to fluid in the casing 130*k* to activate one of the apparatus, and a different signal to subsequently activate the second (and indeed any further apparatus, if provided), the signal detected by the pulsing apparatus. The signal may be generated by switching pumps on and off according to a determined signature, say with pressure applied above a certain threshold or in a certain band for a certain time period, and then switched off and on again. Where the apparatus are to be activated by a single triggering signal, this may be achieved by building in a time-delay to the second and any further apparatus, such that it does not begin transmitting until a first or a preceding apparatus has transmitted data (via pressure pulses) to surface.

The present invention provides for a mud pulse design wherein the entire hydraulic and electronic systems may be contained within the annular wall of a tubular element. The normal mode of operation may be to operate a poppet valve creating a flow path from within the pipe to the lower pressured volume surround the pipe (the borehole) thus generating a negative pulse. However, it is equally possible to reverse the normal valve position and generate what are effectively positive pulses. This latter arrangement would lead to higher wear of the hydraulic components. The electronics assembly will normally be battery powered, although in certain applications the energy requirements would be such that an energy harvesting device could be employed to extract the necessary power from the operating environment. That is, from the discontinuous and irregular motions normally associated with the drilling process. A feature of the invention may be that energy requirements are minimized in order that the power required can be met by batteries, or an energy harvesting system, of very compact dimensions. The electronics may also be very compact in nature. These requirements may be a result of the very limited space available in the wall of the tubular elements used for the drilling process.

Other applications for this technology can be imagined where the pulser may be used for the purpose of transmitting information relating to weight, torque or orientation of a tubular element that is not part of a drill string but rather a 'completion' or other tubular. Multiple (apparatus) units may be deployed in the same string with a suitable coding system to allow determination of which unit each set of data belongs to. This could either provide for redundancy or for simultaneous provision of certain parameters at different vertical heights within the same tubular string.

Options for the present invention include the following. The disclosed MWD tools can be cemented into a wellbore hole. The apparatus may be part of a casing/liner or other tubing string. The apparatus can be used for monitoring bottomhole temperature and/or pressures prior to cementing casing/liner or other tubing, and possibly during the initial displacement of cement. The apparatus can be used for monitoring a pre-milled window orientation or other downhole reference device and subsequently confirming desired orientation if orientation of said equipment has been changed. The apparatus can be used for monitoring orientation of downhole reference devices for subsequent use in surface preparation of equipment with critical orientation requirements relative to the offset data determined downhole. The apparatus can be used for pulsing data either up the bore of a running string or annulus of the running string and casing/liner or other tubing, subject to any restrictions imposed by other equipment in the running assembly at the time (liner hanger, running/setting tool, any other large diameter tool), or large diameter bore to small diameter transitions in the well bore, or small diameter bore to larger diameter bore transitions or combinations. The apparatus may be mounted in the wall of a casing/liner coupling, casing/liner joint or pup joint, casing shoe, centraliser, or special drift component (larger I.D. for equivalent wall thickness/weight casing), larger O.D. with eccentric wall section (lobe), or fluted body for fluid bypass where mounted in the flutes or other device or assembly that may be run or incorporated in the assembly in the well bore at any desired location or depth. The apparatus may be used to monitor and store multiple parameters whilst running in hole and transmit them once at the desired depth in response to establishing a circulation and data transmission regime. The apparatus may monitor any and or all aspects of the following, and not limited to the following, at the casing shoe or higher intervals: pressure and differential pressure, temperature, vibration, formation characteristics, stress and strain (torque, compression, tension, borehole assembly—BHA—weight, bending), stick slip, rpm, at any location from bottom upwards, either selectively in different tools or as a combination of one or more features in one tool (apparatus). Multiple tools (apparatus) may be run in the string and data pulsed back selectively on command or sequentially with all tools operating. The apparatus may be drilled through, may be of drillable materials, and may be drilled through with a drill bit or other appropriate drilling, milling or cutting technology. The apparatus may protrude externally or intrude internally to the appropriate bore. The apparatus may be located in a reduced bore which is subsequently drilled out. A means of isolating the fluid path through the pulser assembly (apparatus) may be provided. There is a possibility of cementing through the apparatus. There is a possibility of running drilling assemblies through the apparatus. Other casing/liner or tubing strings may be run through the apparatus. The apparatus may be run as part of an expandable casing/liner. An assembly including multiple apparatus may be provided to reduce composite errors of equipment assembled on surface and scribed relative to each other whilst running in hole, whereby precise offset between equipment is not exactly known (e.g. multiple pre-milled windows which require to be oriented within a band, say, of 30 deg left or high side of casing). The invention may eliminate the need for an inner running string, such as is required with conventional MWD tools, to pulse orientation data back to surface (such inner strings requiring at least 8 hours rig time to make up and deploy with the casing/liner assembly, with potential well control issues as well as handling time, resulting in significant reduction in deployment time and consequently cost). The apparatus may be incorporated with a turbo casing shoe or other methods to ream with or without casing liner string rotation from surface, such as reamer shoes or the like. The apparatus may be used in multi lateral, lateral, sidetracked and monobore or any other wellbore design.

Those skilled in the art will understand that there are many situations where this invention will allow operation of equipment that heretofore would not have been possible.

Figure 17:
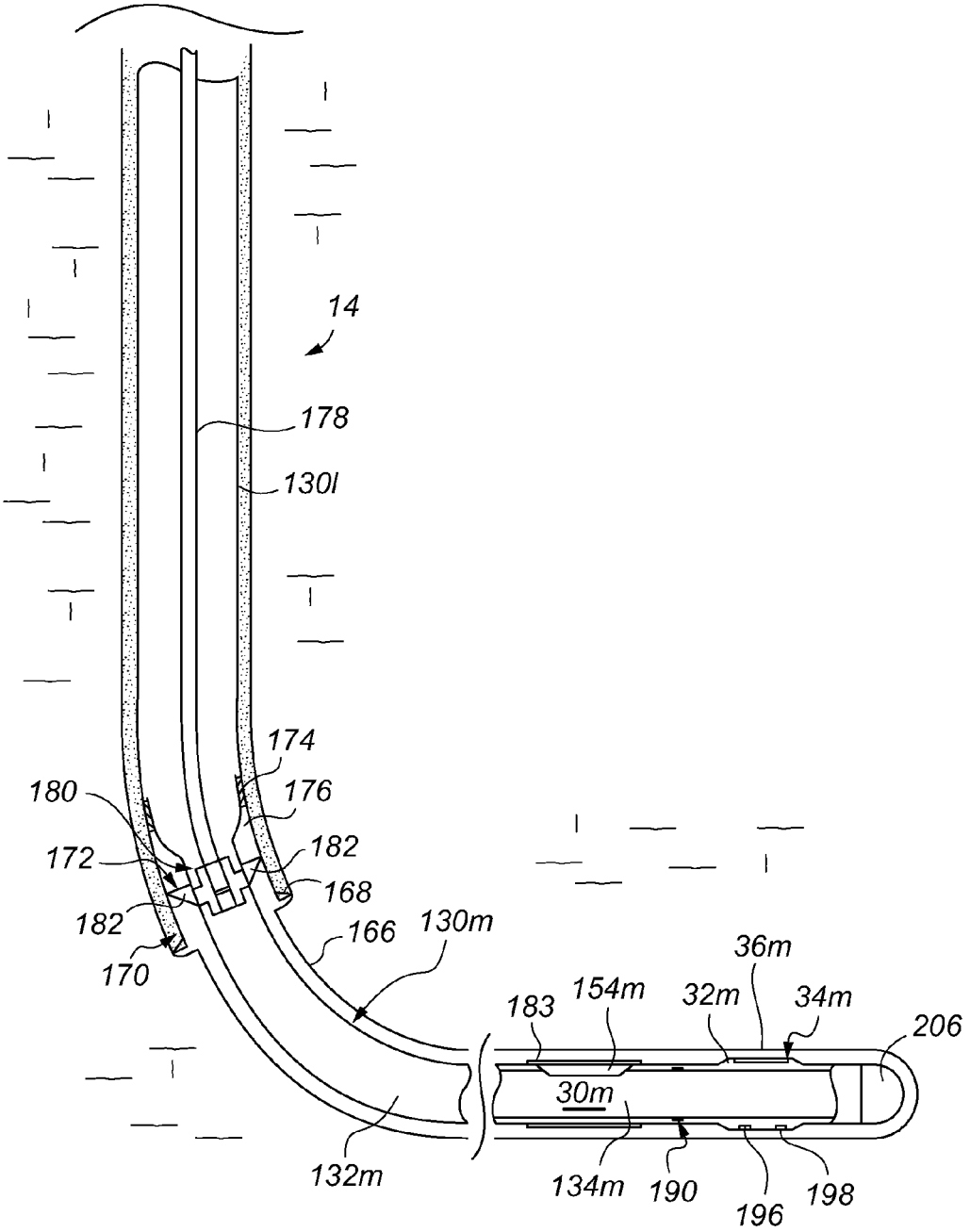
FIGS. 17 to 19 are schematic views of another tubing incorporating apparatus for generating a fluid pressure pulse downhole, illustrating various steps in a method of forming a lateral wellbore, in accordance with an embodiment of the present invention.
Figure 18:
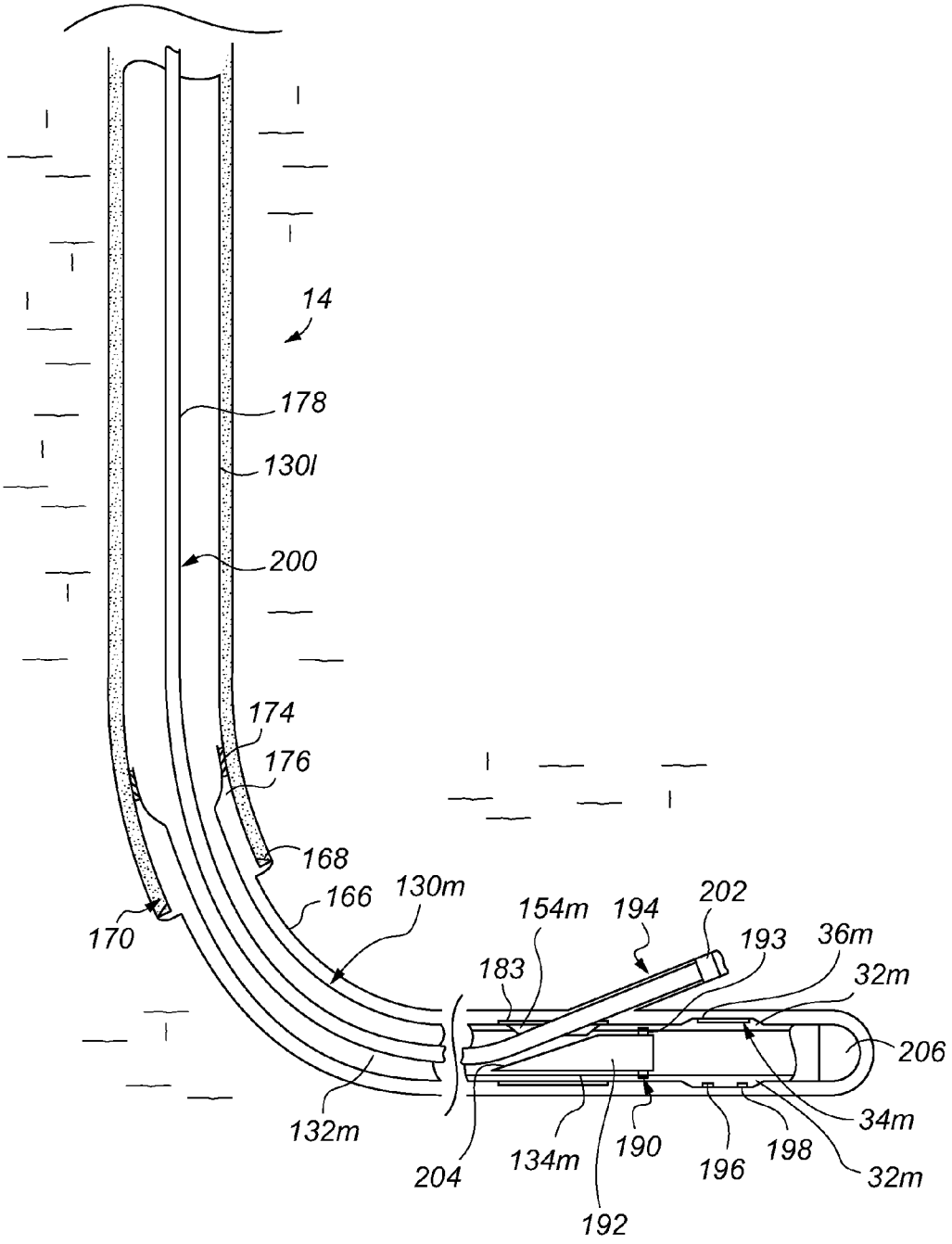
Figure 19:
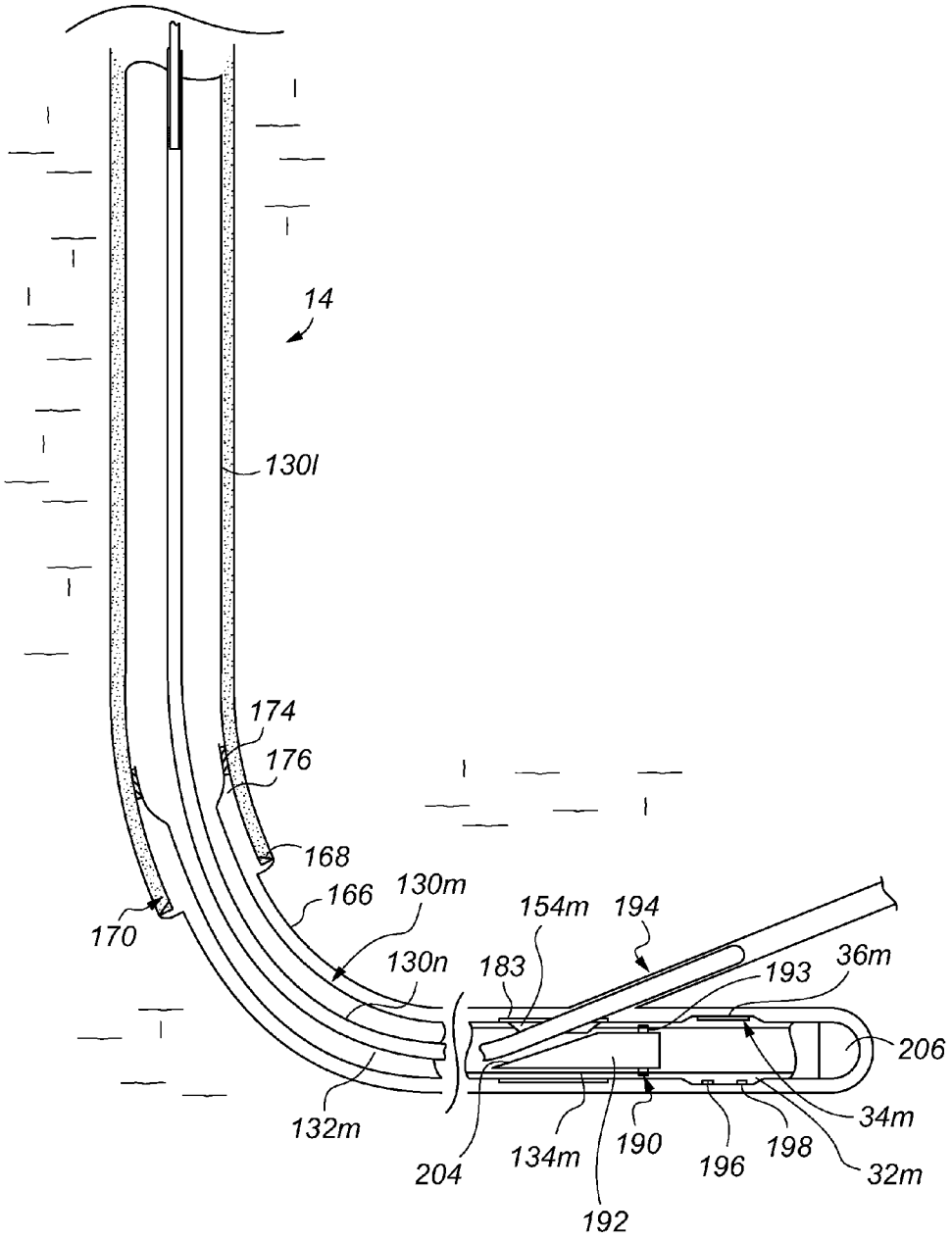

Turning now to FIGS. 17 to 19, there are shown schematic views of another tubing 130*a* incorporating apparatus for generating a fluid pressure pulse downhole, illustrating various steps in a method of forming a lateral wellbore, in accordance with an embodiment of the present invention.

In this embodiment, a casing 130*l* is shown positioned in a wellbore, which is the wellbore 14 shown in FIG. 1. As with previously described casings, the casing 130*l* comprises a series of casing sections coupled together end-to-end, and has been cemented in place within the wellbore 14, in a known fashion. The wellbore 14 has been extended, by drilling a smaller diameter extension 166 through a cement plug and shoe 168 at the end 170 of the casing 130*l*. A wellbore lining tubing 130*m* in accordance with the invention has then be positioned in in the extension 166, extending back into the casing 130*l*.

The tubing 130*m* takes the form of a liner, which is hung and so suspended from the casing 130*l*, in a known fashion. This is achieved using a hydraulically actuated liner hanger 174. A sealing device in the form of an annular liner-top packer 174 is positioned uphole of the hanger 168, and can be actuated to seal an annular region 176 between the liner 130*m* and the casing 130*l*. The liner 130*m* is run-into the wellbore 14 on a tubing string 178, which is typically drill pipe, and is coupled to the drill pipe 178 via a liner hanger setting tool 180. The setting tool is used to hydraulically actuate the liner hanger 172, to urge slips 182 outwardly to engage the casing 130*l*.

The liner 130*m*, and its employment in the method of the invention, will now be described in more detail. The liner 130*m* incorporates a device for generating a fluid pressure pulse of the type shown in FIGS. 1 to 16 and described above, the device indicated generally by numeral 34*m*, and in particular a device (12*b*) of the type shown in FIGS. 6 to 8*c*. The liner 130*m* comprises a wall 32*m*, and the device 34*m* is located in a space 36*m* in the wall. In this embodiment, the liner wall 32*m* forms an upset which defines the space 36*m* which carries the pulse generating device 34*m*. The liner 130*m* also comprises an internal fluid flow passage 30*m*, and at least one window 154*m* pre-formed in the wall of the tubing.

The window 154*m* is pre-formed by a material removal process, in particular by milling. However, other suitable processes may be employed to pre-form the window. Whilst the window 154*m* is pre-formed in the material of the liner 130*m*, it is necessary to close off the window to enable various downhole procedures to be performed. Such includes, but is not limited to, cementation of the liner 130*m* and operation of the pulse generating device 34*m*. The window is closed off by a sleeve 183 or the like, which is of a material having a higher hardness than that of the liner 130*m*, and so which is easily milled or drilled out. For example, the liner 130*m* may be of a steel and the sleeve 183 of an aluminium alloy. In the illustrated embodiment, the liner comprises only the single window 154*m*, however, in a similar fashion to the embodiment of FIG. 16, it will be understood that there may be a plurality of such windows in the liner 130*m*, which may be spaced some hundreds or thousands of meters apart along a length of the wellbore 14. Wellbore-lining tubing such as liner comprising a pre-formed window, suitable for use as the liner 130*m*, is commercially available from Halliburton Corporation under the FlexRite® Trade Mark.

The liner 130*m* further comprises a coupling which is indicated schematically by numeral 190, and which is known as a latch coupling. The latch coupling 190 is for receiving a deflection tool in the form of a whipstock 192, which is shown in FIG. 18, for releasably securing the whipstock to the liner 130*m*. The whipstock 192 is employed to divert a downhole component through the window 154*m* in the liner wall 32*m*, as will be described below. The latch coupling 190 typically takes the form of a profile such as a recess, channel, groove or the like formed in the wall 32*m* of the liner 130*m*, and which is engaged by suitable engaging elements such as dogs 193 on the whipstock 192. However, the latch coupling may define an upset and may be a ring or shoulder which the whipstock 192 can seat on and latch to. The latch coupling 190 may be arranged so that it receives the whipstock 192 in a discrete or predetermined orientation, which may be a rotational orientation of the whipstock. In this way, the whipstock 192 may only be capable of being secured to the latch coupling 190 in the discrete/predetermined position, to ensure correct rotational orientation. Optionally, a plurality of discrete positions for the deflection tool may be defined.

The invention of this embodiment of the invention provides the ability to address problems associated with prior lateral drilling techniques, especially multi-lateral drilling techniques. In particular, providing the liner 130*m* with the device 34*m* for generating a fluid pressure pulse located at least partly in the space 36*m* provided in the wall 32*m* of the liner can provide the following benefits. It avoids restriction of the tubing bore 30*m*. It also permits a more conventional cement job to be carried out, as there is no need to isolate the device 34*m* from cement, since it remains within the wellbore, forming part of the completion. Operation of the device 34*m* avoids contamination of the cement, because any drilling or like fluids employed to signal to surface reside in the annular region 176 between the liner 130*m* and the wellbore 14 wall, above cement which is charged into the annular region. The residual drilling fluid is urged towards surface along the annular region 176 ahead of the cement. It avoids the requirement to provide a dedicated inner tubing string, with consequent weight savings, as is the case with prior techniques. This permits longer (i.e. heavier) multilateral completion strings of wellbore-lining tubing to be run, suspended from a rig at surface, and also reduces rig time, by perhaps as much as 8 to 16 hours (with consequent benefits in terms of cost savings and safety improvements).

As will be understood by persons skilled in the art, the liner 130*m* typically comprises a number of sections of liner tubing coupled together end-to-end. Two such liner sections 132*m* and 134*m* are shown in the drawing, although further sections which are not shown will make up the complete liner 130*m*. The liner section 134*m* comprises the window 154*m*, the pulse generating device 34*m* and the latch coupling 190, which are therefore provided integrally in the casing section 134*m*. In other words, a single tubing section 134*m* is provided which comprises the window 154*m*, the pulse generating device 34*m* located in the space 36*m* in the wall 32*m* of the tubing, and the latch coupling 190. This is advantageous in that all of the components can be provided in a single tubing section (or conceivably a single tubing e.g. where a continuous length tubing such as coiled tubing is employed), facilitating make-up and running of the liner 130*m*.

Optionally however, the window 154*m*, pulse generating device 34*m* and/or the latch coupling 190 may be provided in separate tubing sections which form part of the liner 130*m*. For example, a first section of the liner 130*m* may comprise the window 154*m*; a second section may comprise the space 36*m* with the pulse generating device 34*m* located at least partly in the space; and a third section may comprise the latch coupling 190 for the whipstock 192. The tubing sections may be coupled together end to end, or spaced apart by at least one further tubing section, in appropriate circumstances. One tubing section may comprise at least two of the window 154*m*, space 36*m*/pulse generating device 34*m* and latch coupling 190.

The liner 130*m* has a particular utility in a method of forming a lateral wellbore, and in particular in a multi-lateral wellbore formation procedure (where the liner 130*m* would comprise a plurality of windows, as described above). FIG. 18 shows steps in the method of forming a lateral wellbore 194. Following positioning of the liner 130*m* in the extension 166 of the main wellbore 14, a sensor 196 detects a position of the window 154*m* relative to the high side of the wellbore (in the case of a deviated wellbore), and a sensor 198 the rotational orientation (azimuth) of the liner section 134*m*, so that data relating to the position of the window 154*m* can be derived. Such sensors 196/198 are known in the field of the invention. Optionally, the depth of the window 154*m* may be determined using an appropriate sensor, which detects the presence of a feature which is at a known depth in the wellbore. The feature may be a geological feature. The feature may be a feature of another tubing, in particular the casing 130*l*, or another downhole component. For example, a casing collar locator (CCL—not shown) may be provided for detecting collars (also not shown) between sections of the casing 130*l* through which the liner 130*m* is run and from which it is hung. The depth of the casing 130*l* collars in the wellbore 14 is known, facilitating determination of depth by counting the collars.

The fluid pressure pulse generating device 34*m* is then activated, to generate pressure pulses for transmitting data to surface relating to the rotational orientation (azimuth) of the liner window 154*m* in the main wellbore extension 166, and optionally also the depth of the window 154*m*. The rotational orientation of the pulse generating device 34*m* in the liner section 134*m* is known, as is the position of the device along the length of the tubing section. Thus the rotational orientation of the device 34*m* relative to the window 154*m*, and the axial spacing between the device 34*m* and the window 154*m*, is known. In this way, data relating to the rotational orientation of the window 154*m* in the wellbore extension 166, and optionally the depth, can be derived. At this stage, the wellbore 14 contains a suitable fluid such as drilling mud, and the device 34*m* generates fluid pressure pulses to transmit data representative of the measured parameter (azimuth, optionally depth) to surface, following the techniques described above. Typically, fluid will be vented to the annular region 166 during pulse generation.

Following verification of window 154*m* azimuth (and optionally depth), the liner 130*m* can then be cemented in place in the main wellbore extension 166, employing a conventional cementing procedure. Using a suitable arrangement of cement plugs (not shown), cement is supplied into the liner 130*m*, and forced down under pressure to a cement shoe 206 having a float collar (not shown). The shoe 206 permits cement to flow out of the liner 130*m* and into the annular region 166, where it flows along the wellbore extension 166 and back into the casing 130*l*, to seal the liner 130*m*. The liner-top packer 174 can then be actuated to seal the annular region 166 above the cement. As mentioned above, during cementation, any drilling fluid remaining in the annular region 166 is carried ahead of the cement, and so does not contaminate it as in the prior technique.

Following cementation, the whipstock 192 is run-in and secured to the liner 130*m* by means of the latch coupling 190. The whipstock 192 can then be used to divert a downhole component through the window in the tubing wall. In the illustrated example of the formation of a lateral wellbore 194, a drill string 200 carrying a drill bit 202 is run into the wellbore 14 and, on encountering the whipstock 192, is diverted through the liner window 154*m*. The drill bit 202 drills through the softer material of the sleeve 183, and is advanced to form the wellbore 194. The whipstock 192 has a hardened face 204, and is positioned in the liner passage 30*m* at an appropriate rotational orientation for kicking the lateral 194 off at a desired azimuth and inclination. A smaller diameter liner 130*n* can then be run into the wellbore 14 and diverted into the lateral wellbore 194 using the whipstock, although the whipstock may be retrieved to surface and a dedicated diverter tool coupled to the latch coupling 190 and used to deflect the liner 130*n*. Following conventional methods, the liner 130*n* is cemented in the lateral wellbore 194, and the portion of liner 130*n* extending into the liner 130*m*, and residual cement, milled out to reopen the liner bore 30*m*.

It will be appreciated that the method of this embodiment of the invention may permit a component to be run into the lateral wellbore 194 following drilling and lining of the lateral wellbore. Such might include, but is not limited to, intervention or workover equipment.

The method may comprise closing the downhole end of the liner 130*m*, to prevent fluid flow from the liner into the wellbore extension 166. The method may comprise plugging the downhole end of the liner 130*m*, for example via a drillable plug (not shown) provided in place of the cement shoe 206, and drilling the plug out to open fluid communication and/or to extend the main wellbore 14 following completion of the procedure. The method may comprise raising the pressure of fluid in the internal flow passage 30*m* of the liner 130*m* relative to the pressure of fluid externally of the liner, in the annular region 176, and employing the pressure differential to generate fluid pressure pulses by opening flow to the exterior of the tubing using the pulse generating device 34. Such may be in accordance with WO-2011/036471, the disclosure of which is incorporated herein by way of reference.

The liner 130*m* may be capable of being employed in a casing drilling procedure, and may comprise a drilling, milling and/or reamer device, such as a reamer shoe. The liner 130*m*, or at least part of the liner, may be rotated to advance or enlarge the main wellbore.

Various modifications may be made to the foregoing without departing from the spirit or scope of the present invention.

For example, the tubular housing of the apparatus may comprise a plurality of housing components or parts which together form the housing. The housing may comprise an outer housing part, which may define an outer surface of the housing, and an inner housing part, which may define the space. The inner housing part may define at least part of the internal fluid flow passage. The inner housing part may be located within the outer housing part, and may be releasably mountable within the outer housing part.

The fluid flow passage may be of a substantially uniform cross-section along a length thereof, or a shape of the fluid flow passage in cross-section, and/or a cross-sectional area of the passage, may vary along a length thereof. The inlet and the outlet may both communicate with the interior of the tubular housing. The inlet may open on to a part of the tubular housing which is upstream of the outlet in normal use of the apparatus. The inlet and/or the outlet may be flow ports, and may be radially or axially extending flow ports.

The valve of the apparatus may be operated hydraulically or indeed mechanically or otherwise.

The apparatus may be arranged/the method may involve actuating the device to permit fluid flow from an inlet to an outlet, the inlet and the outlet both communicating with the interior of the tubular housing. The inlet may open on to a part of the tubular housing which is upstream of the outlet in normal use of the apparatus.

Further embodiments of the invention might comprise features derived from one or more of the above described embodiments taken in combination.

The invention claimed is:

1. A wellbore-lining tubing comprising:

a cylindrical tubing wall, an internal fluid flow passage defined by the tubing wall, and at least one window pre-formed through the tubing wall;

a pulse generating device comprising a cartridge releasably mounted within a space defined in an external surface of the tubing wall, the pulse generating device having an inlet in fluid communication with the internal fluid flow passage and a flow port that communicates with an exterior of the wellbore-lining tubing, wherein the internal fluid flow passage is unrestricted where the pulse generating device is received within the space;

a pressure balancing system included in the pulse generating device and operable to balance pressure forces acting on a valve actuatable to selectively generate fluid pressure pulses; and a coupling for securing a deflection tool within the tubing and employed to divert a downhole component through the at least one window in the tubing wall.

2. The tubing as claimed in claim 1, wherein the tubing comprises a plurality of tubing sections coupled together, and wherein a single tubing section comprises the window, the space, the pulse generating device which is located in the space in the wall of the tubing section, and the coupling.

3. The tubing as claimed in claim 1, wherein the tubing comprises a plurality of tubing sections coupled together, and wherein the window, the pulse generating device and the coupling are provided in separate tubing sections.

4. The tubing as claimed in claim 1, in which the tubing comprises a plurality of tubing sections coupled together, and in which one tubing section comprises two of the window, pulse generating device and coupling.

5. The tubing as claimed in claim 1, wherein the internal fluid flow passage is a primary fluid flow passage, and the pulse generating device further defines a secondary fluid flow passage extending between the inlet and the flow port; and the cartridge houses the valve comprising a valve element and a valve seat, the valve being actuatable to control fluid flow through the secondary fluid flow passage to selectively generate the fluid pressure pulses.

6. The tubing as claimed in claim 1, in which the tubing is capable of being employed in a casing drilling procedure, and comprises a casing reamer shoe.

7. The tubing as claimed in claim 1, in which the coupling is a latch coupling positioned within the internal passage of the tubing to which the deflection tool can be releasably latched, for securement of the deflection tool to the tubing.

8. The tubing as claimed in claim 1, in which a cement shoe is provided at a downhole end of the tubing, for permitting fluid to flow out of the tubing into the wellbore.

9. The tubing as claimed in claim 1, in which the tubing is closed at a downhole end thereof, to prevent fluid flow from the tubing into the wellbore.

10. The tubing as claimed in claim 9, in which the downhole end of the tubing is drillable, for selectively opening the downhole end of the tubing.

11. A method of forming a lateral wellbore, the method comprising the steps of:

drilling a main wellbore;

locating a wellbore-lining tubing in the main wellbore, the wellbore-lining tubing having:

a cylindrical tubing wall, an internal fluid flow passage defined by the tubing wall, and at least one window pre-formed through the tubing wall;

a pulse generating device comprising a cartridge releasably mounted within a space defined in an external surface of the tubing wall, the pulse generating device having an inlet in fluid communication with the internal fluid flow passage and a flow port that communicates with an annulus defined between the main wellbore and the wellbore-lining tubing, wherein the internal fluid flow passage is unrestricted where the pulse generating device is received within the space; and a coupling for securing a deflection tool within the wellbore-lining tubing;

following location of the wellbore-lining tubing in the main wellbore, activating the pulse generating device to generate fluid pressure pulses for transmitting data relating to a rotational orientation of the at least one window in the main wellbore to surface;

balancing pressure forces acting on a valve with a pressure balancing system included in the pulse generating device, wherein the valve is actuated to selectively generate the fluid pressure pulses;

securing a deflection tool within the wellbore-lining tubing at the coupling; and diverting a downhole component through the at least one window in the tubing wall via the deflection tool.

12. The method as claimed in claim 11, further comprising determining the rotational orientation of the window using a sensor.

13. The method as claimed in claim 11, in which the wellbore is a deviated wellbore, and comprising detecting a position of the window relative to a high side of the wellbore using a sensor.

14. The method as claimed in claim 11, further comprising determining the depth of the window in the main wellbore using a sensor, and using the pulse generating device to transmit data relating to the depth of the window to surface.

15. The method as claimed in claim 11, further comprising forming a plurality of lateral wellbores each extending from the main wellbore, the wellbore-lining tubing comprising a plurality of pre-formed windows each associated with a respective lateral wellbore.

16. The method as claimed in claim 15, wherein the wellbore-lining tubing comprises a plurality of couplings, each associated with a respective lateral wellbore window.

17. The method as claimed in claim 15, wherein the pulse generating device is a first pulse generating device and the tubing further has a plurality of pulse generating devices, each associated with a respective pre-formed window of the plurality of preformed windows.

18. The method as claimed in claim 15, wherein the wellbore-lining tubing comprises a plurality of lateral wellbore windows, the method further comprising transmitting data relating to the plurality of lateral wellbore windows to surface using the pulse generating device.

19. The method as claimed in claim 11, in which the downhole component is a tool for drilling and extending the lateral wellbore, and the method comprises drilling the lateral wellbore through the window using the tool.

20. The method as claimed in claim 11, in which the downhole component is a smaller diameter wellbore-lining tubing to be installed in the lateral wellbore extending from the at least one window, and the method comprises lining the lateral wellbore using the smaller diameter wellbore-lining tubing.

21. The method as claimed in claim 20, further comprising cementing the wellbore-lining tubing in the main wellbore following transmission of the data to surface and following lining of the lateral wellbore.

22. The method as claimed in claim 19, wherein the tool is a first downhole component and the method further comprises subsequently employing the deflection tool to divert a second downhole component in the form of a smaller diameter wellbore-lining tubing through the at least one window and into the lateral wellbore.

23. The method as claimed in claim 22, further comprising cementing the wellbore-lining tubing in the main wellbore following transmission of the data to surface and following drilling and lining of the lateral wellbore.

24. The method as claimed in claim 11, in which the downhole component is a component which is to be run into a lateral wellbore extending from the at least one window following drilling and lining of the lateral wellbore.

25. The method as claimed in claim 11, further comprising:

closing a downhole end of the tubing, to prevent fluid flow from the tubing into the wellbore;

raising a fluid pressure in the internal flow passage of the tubing relative to a fluid pressure external to the tubing; and employing a pressure differential between the fluid pressure in the internal flow passage and the fluid pressure external to the tubing to generate fluid pressure pulses by selectively opening flow to an exterior of the tubing using the pulse generating device.

26. The method as claimed in claim 25, further comprising subsequently opening the downhole end of the tubing.

* * * * *